US008132290B2

(12) United States Patent
Liang et al.

(10) Patent No.: US 8,132,290 B2
(45) Date of Patent: Mar. 13, 2012

(54) BLOCK AND TACKLE BALANCE ASSEMBLY WITH ROTATABLE SHOE

(75) Inventors: Luke Liang, South Plainfield, NJ (US); Tong Liang, Guangzhou (CN); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 68 days.

(21) Appl. No.: 12/218,764

(22) Filed: Jul. 17, 2008

(65) Prior Publication Data

US 2010/0011669 A1 Jan. 21, 2010

(51) Int. Cl.
*E05D 13/00* (2006.01)

(52) U.S. Cl. ..... 16/193; 16/197; 49/181

(58) Field of Classification Search ..... 49/447, 49/445, 181; 160/189, 190; 16/193, 197
See application file for complete search history.

(56) References Cited

U.S. PATENT DOCUMENTS 3,178,761 A * 4/1965 Restaino ..... 16/257
4,610,108 A * 9/1986 Marshik ..... 49/181
5,036,622 A * 8/1991 Stark ..... 49/445
6,622,342 B1 * 9/2003 Annes et al. ..... 16/197
6,892,494 B2 * 5/2005 Malek ..... 49/181
7,673,372 B2 * 3/2010 Annes et al. ..... 16/197
2005/0178068 A1 * 8/2005 Uken et al. ..... 49/445
2005/0188620 A1 * 9/2005 Malek et al. ..... 49/181
2006/0207185 A1 * 9/2006 Shuler et al. ..... 49/445

* cited by examiner

*Primary Examiner* — Victor Batson
*Assistant Examiner* — Matthew Sullivan
(74) *Attorney, Agent, or Firm* — Thomas A O'Rourke; Bodner & O'Rourke, LLP

(57) ABSTRACT

A balance assembly for a sliding sash window, where a spring-loaded pulley arrangement is interconnected between the window frame and the window, to counter the weight of the window, and permit ease of opening and closing the window. The spring-loaded pulley arrangement is located within a housing, which also facilitates attachment of the shoe. The shoe of this balance assembly being rotatable between a first and a second position to permit fitting the assembly into the side of the window frame, when the shoe is in the first position, and to permit final installation of the assembly when the shoe in the second position. The shoe is retained in the first and second positions by detents. This rotatable shoe feature permitting installation, of the Balance Assembly of this invention, into a window frame at later stages of the window assembly sequence.

49 Claims, 19 Drawing Sheets

BLOCK AND TACKLE BALANCE ASSEMBLY WITH ROTATABLE SHOE

FIELD OF THE INVENTION

This invention relates to a balance system for use in a pivotable, sliding window assembly of a sash window, and more particularly to a block and tackle balance assembly with a rotatable shoe.

BACKGROUND OF THE INVENTION

A sash window is comprised of one or more moveable panels or sashes, where each sash forms a frame that may hold multiple panes of glass, and both sashes are themselves mounted into a window frame. A "single hung" sash window ordinarily opens by having one sash member, typically the lower sash, sliding vertically relative to the window frame. An arrangement where both sash members can slide vertically is termed a "double hung sash window" or double hung window. For applications in buildings with tall openings, such as for church windows, triple and quadruple-hung windows have been utilized to accommodate the opening.

Each sash member, being comprised of multiple panes of glass housed in a wood frame of the sash, would be quite heavy for most homeowners to open or close with relative ease. Such sash members have traditionally been fitted with a means of counterbalancing the weight of the window panes and frame of the sash member, where such balancing means even permits small children to raise and lower the heavy sash member. Although advances in the materials used for the construction of sash frames, beyond the use of wood, may have lead to reductions in the final weight of the sash members, any reductions have been largely been offset by the use of the double paned glass arrangement, which was developed to increase thermal efficiency.

The means of counterbalancing the sliding sash windows, in its early and perhaps simplest form, was just a cord attached at one end to a counter weight, with the cord crossing a pulley and, at the opposite end, attaching directly to the window. The mass of the weight in that arrangement is necessarily calibrated to counter the weight of the sash member and the friction of the pulley. If the counterweight were sized excessively, the sash member would be difficult to close and would tend to not remain shut. Conversely, if the counterweight were undersized, the sash member would be difficult to open, and would tend to not remain open.

An early patent, U.S. Pat. No. 395,165 to Morgan, shows an arrangement in which the counterweight was replaced by a reel or drum to collect the cord, and a coiled counterbalancing spring within the drum. A common spring for this application was a negator spring, which is a thin flat metal band that is coiled similar to a tape measure. The Morgan approach eliminated the need for the weights, but necessitated housing a drum having a diameter of significantly size, as well as ordinarily permitting some exposure of the drum to provide access for the cord to run down to and attach to the window. These reels or drums are visible, even today, in the windows of many older homes and apartments. Some of these older balance arrangements also make use of a chain in place of the cord.

Counterbalancing of sash windows in the early to middle part of the twentieth century saw the use of helical coil springs in place of the negator spring and reel combination. An early example is shown by U.S. Pat. No. 2,329,463 to Froelich. The Froelich patent incorporates a helical spring within a tubular member which is rotatably mounted, where the tubular member has a spiral thread on its exterior surface that is designed to be engaged by a member secured to the window frame. As the upper sash window is lowered from its rest position, the tubular member is turned and applies more tension to the spring, so that energy stored in the spring can check the window from falling, and may also help in raising the sash member when desired. The arrangement could similarly be rotated to be preloaded upon installation, to counterbalance the weight of the lower sash member and assist in raising it at the appropriate time. Also, U.S. Pat. No. 3,064,306 to Beasley shows another basic spring arrangement, both of which were advantageous over the Morgan approach for, among other things, the reduction in the depth required to house the reel.

An early example of a balance system with helical coil springs and a block and tackle system for countering the weight of the sash member, is shown by U.S. Pat. No. 3,358,403 to Dinsmore. This basic arrangement is part of a class of similar patents, which have progressively become more streamlined and efficient, and have even been adapted to permit use with a pivotable window.

But a serious deficiency of these inventions—because of the limited envelope of the frame, and the size of the "shoe" on such balance assemblies that must necessarily nest within that envelope—is the limitation that the balance assemblies must be fitted into the frame at an early stage of the window assembly sequence by using an intricate installation procedure. This invention eliminates those restrictions by providing a window balance assembly which is transformable to facilitate installation into the frame with ease and at later stages.

SUMMARY OF THE INVENTION

The balance system of this invention is adapted to easily fit into the frame of a sliding sash window, and is specially configured so that it may be so installed during almost any phase of window assembly, but particularly at a later phase of assembly than is ordinarily possible.

The balance assembly of this invention includes a spring-loaded pulley arrangement that connects to the window frame and to the sash window, in order to counter the weight of the window, and to permit ease of opening and closing the sash window. The pulley arrangement can include of one or more pulleys, but in a preferred embodiment, is a block and tackle arrangement utilizing two upper pulleys in an upper rectangular frame and two lower pulleys in a lower diamond shaped frame, with a flexible interconnection means. The interconnection may be a cord, cable, chain or other flexible member. In the preferred embodiment, the interconnection means attaches to the diamond shaped frame, usually with a simple knot, then loops around the pulleys to exit past the rectangular frame and attach to a mounting clip. The interconnection means usually attaches to the mounting clip by running through an orifice in a mounting clip flange and terminating in a knot.

The housing may be in many different cross-sectional shapes, bit is preferably a U-shaped channel. The block and tackle pulley arrangement may be installed within the housing of the balance assembly using a number of different fastening systems, including but not limited to screws, nut and bolts, etc. but in a preferred embodiment, a pin is used to fix the upper rectangular frame to the housing. The lower diamond shaped frame of the block and tackle pulley arrangement is biased relative to the housing by attaching a helical spring member, preferably having hooked open ends, to a pin that spans the housing sidewalls, and to an orifice in the diamond shaped frame. The housing may also facilitate attachment of the rotatable shoe.

The shoe of this balance assembly is configured to accommodate a cam, which is utilized to provide the pivot feature of a pivotable window. In a preferred embodiment the cam motion may be inhibited, for a portion of its rotation. The motion may be inhibited, in a preferred embodiment, through use of a leaf spring, where cam features and the spring combine to act like a detent to initially restrict cam motion, and thus the pivoting motion of the window. The shoe may be attached to the housing using a hook means which enables the shoe to rotate between a first and a second position, which permits fitting the balance assembly into the side of the window frame when the shoe is in the first position, where subsequent shoe rotation permits final installation of the balance assembly when the shoe in the second position. The shoe may be retained in the first and second positions by detents in the shoe, where the detents act upon the hook means that attaches the shoe to the housing.

This rotation ability of the shoe permits installation of the Block and Tackle Balance Assembly with Rotatable Shoe into a window frame at any stage of the window assembly sequence, permitting the balance assembly to be easily installed at a more advantageous time in the assembly sequence.

DETAILED DESCRIPTION OF THE PREFERRED EMBODIMENT

Figure 1:
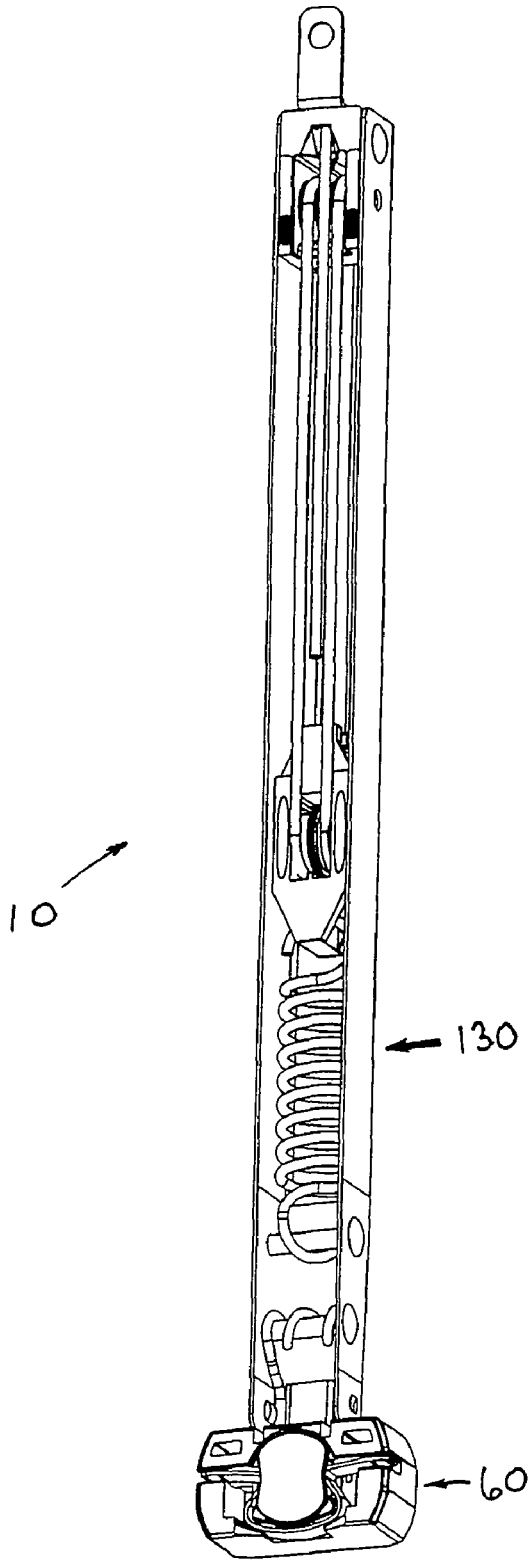
FIG. 1 is a front view of the Block and Tackle Balance Assembly with Rotatable Shoe.

The Block and Tackle Balance Assembly with Rotatable Shoe 10 is shown in FIG. 1. The block and tackle balance assembly with rotatable shoe 10 is comprised, in a preferred embodiment, of Housing Assembly 130, and Shoe Assembly 60.

Figure 4:
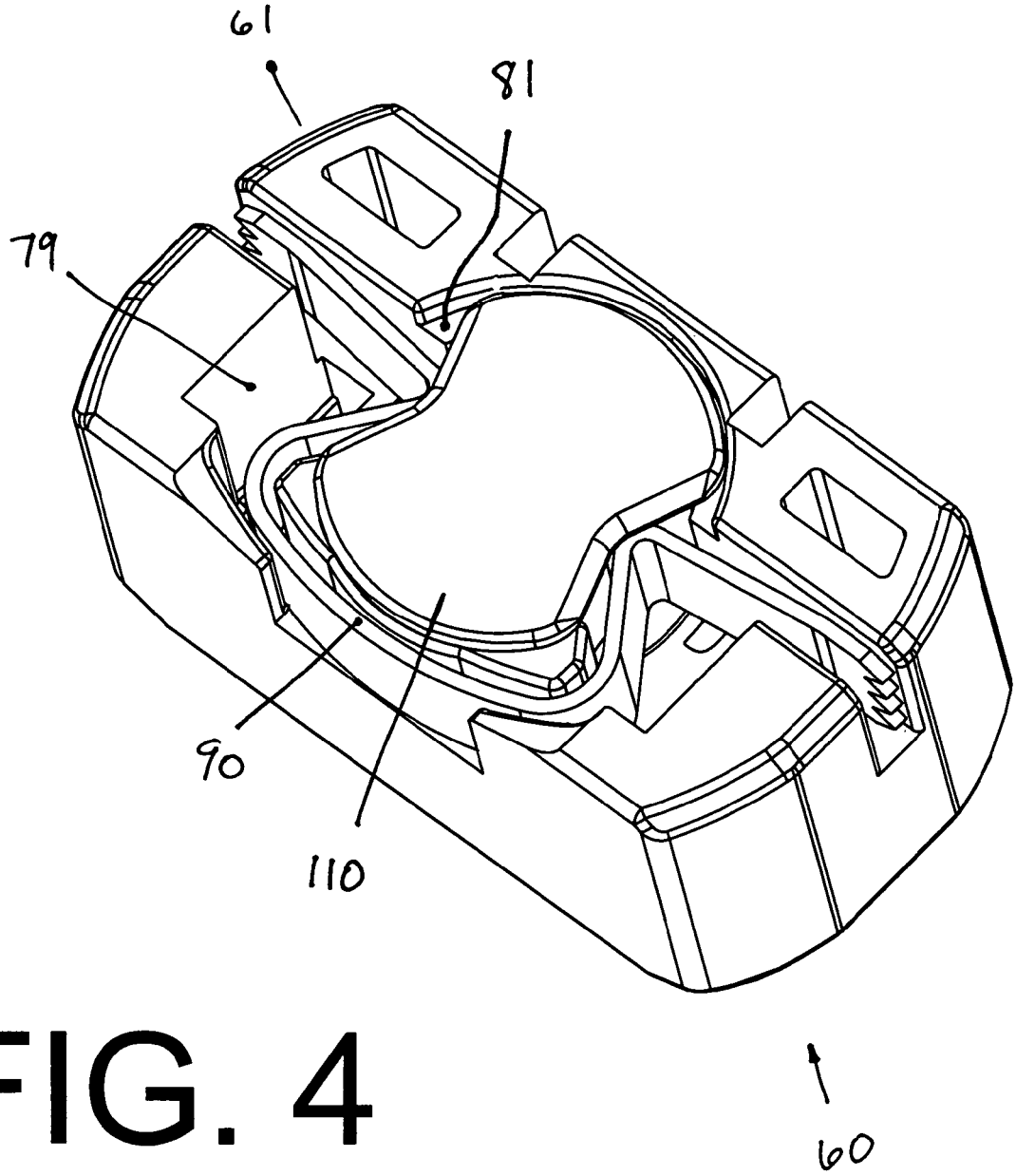
FIG. 4 is a perspective view of the bottom of the Shoe Assembly.
Figure 8:
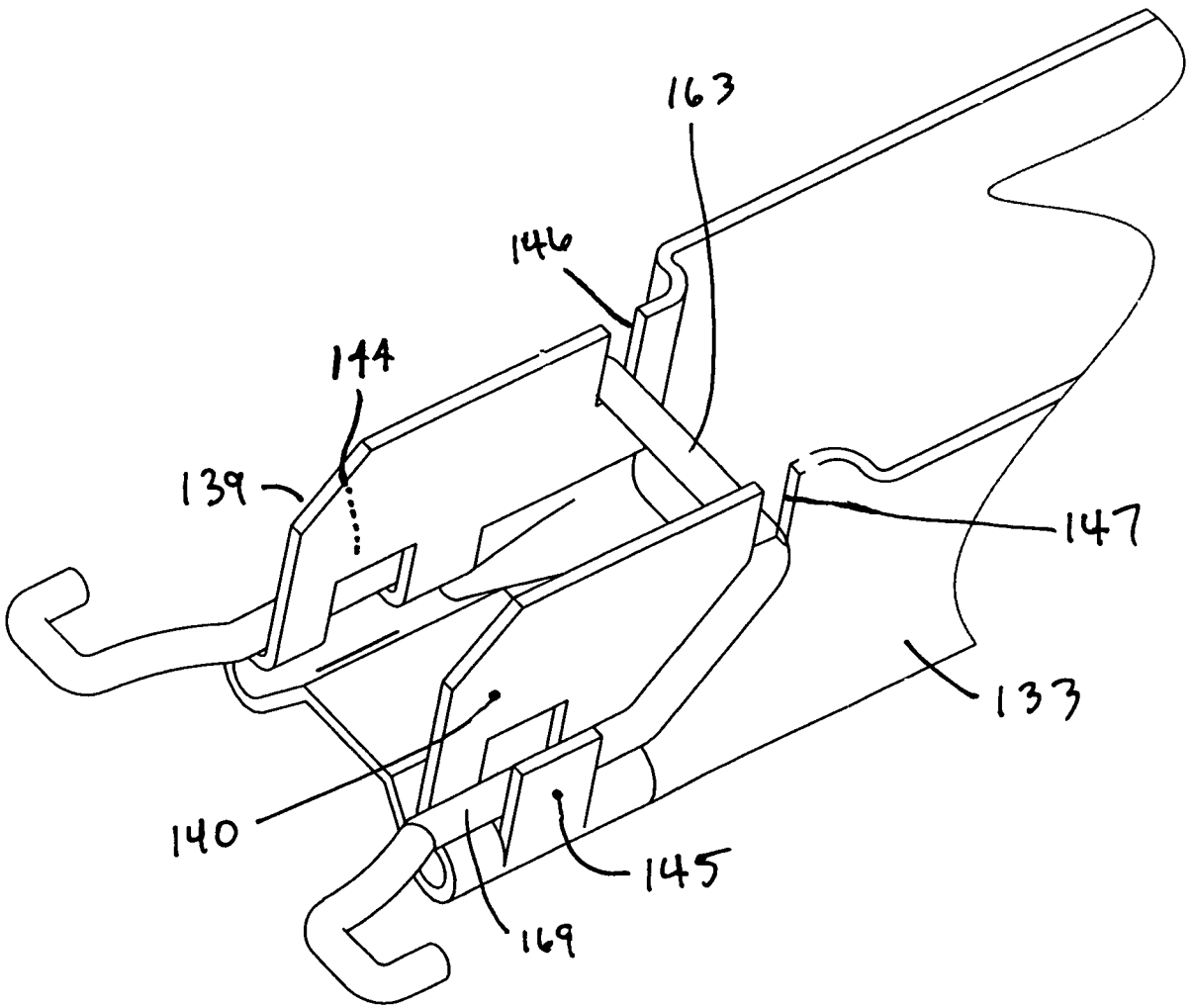
FIG. 8 is a perspective view of the Hook Means fitted into the Lower End of the Housing before being permanently attached to the housing, in the preferred embodiment.

The housing assembly 130 is comprised of housing 131, Hook Means 160, a pulley arrangement 20, Helical Member 50, and Pins 15 and 16 (see FIGS. 1, 4, and 8). The pulley arrangement 20 (see FIG. 2) could include of a pulley, but in the preferred embodiment is a block and tackle. The block and tackle pulley arrangement 20 of the preferred embodiment includes an interconnection means 21. The interconnection means 21 may be, but is not limited to, a cord, string, a cable, a chain, etc.

The block and tackle pulley arrangement 20 may also include frame 24 with a cavity 29 in which the frame 24 is capable of pivotally mounting a first upper pulley 25 and a second upper pulley 26. Frame 24 may be in many different shapes, but in a preferred embodiment, it is a rectangular frame. Pivotal mounting to frame 24 is achieved through use of pin 27, which spans the frame 24, to trap pulleys 25 and 26 within cavity 29 of frame 24. Frame 24 will preferably include an orifice 28 to aid in mounting the frame 24 into housing 131, which be discussed later. The block and tackle pulley arrangement 20 may further include a second frame 30, which, similar to the rectangular frame 24, has a cavity 35 in which first lower pulley 31 and second lower pulley 32 are pivotally mounted through use of pin 33. The second frame 30 may also be in many different shapes, but in the preferred embodiment, frame 30 is diamond shaped. The diamond shaped frame 30 also has an orifice 34 which will be utilized during installation of the block and tackle pulley arrangement 20, as described later. With the upper pulleys 25 and 26 pivotally mounted in rectangular frame 24, and the lower pulleys 31 and 32 pivotally mounted in the diamond-shaped frame 30, the first end of interconnection means 21 may be attached to the diamond shaped frame 30, preferably using knot 23. The interconnection means 21 then runs up into the cavity of the rectangular shaped frame and around pulley 25, down to pulley 31, around pulley 31 and then up to pulley 26, around pulley 26 and then down to pulley 32, around pulley 32 then up through the cavity 29 of rectangular frame 24 and out the top of frame 24, where the second end of interconnection means 21 attaches to mounting clip 40, in a preferred embodiment, using knot 22.

Mounting clip 40 may be utilized in many different shapes, but is preferably just a clip with two flanges—first flange 41 and second flange 42—that are generally at some angle to each other, which preferably is roughly a 90 degree angle. The first flange 41 has an orifice 43 through which interconnection means 21 runs, and beyond which knot 22 on interconnection means 21 is created. The second flange 42 may have an orifice 44 for use in attaching the mounting clip to a window frame, or alternatively, it may be attached to the window.

Figure 1A:
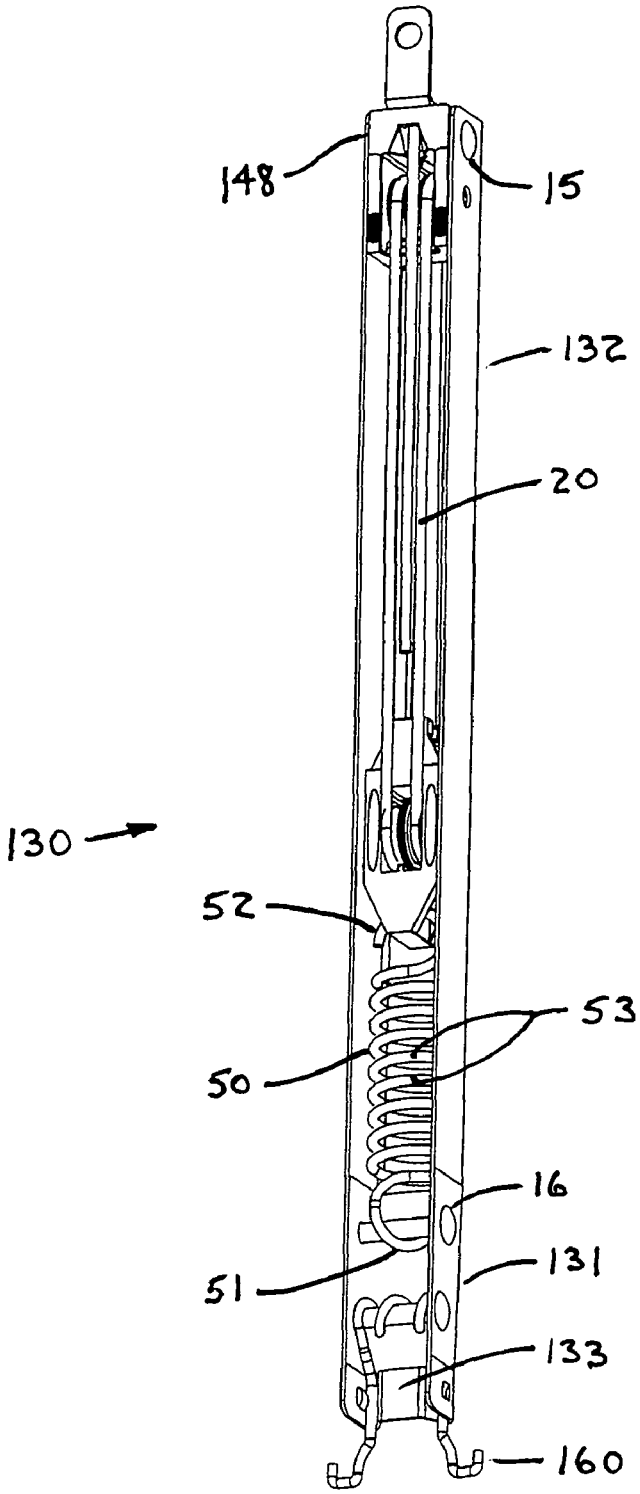
FIG. 1A is a front view of the Housing Assembly.
Figure 7:
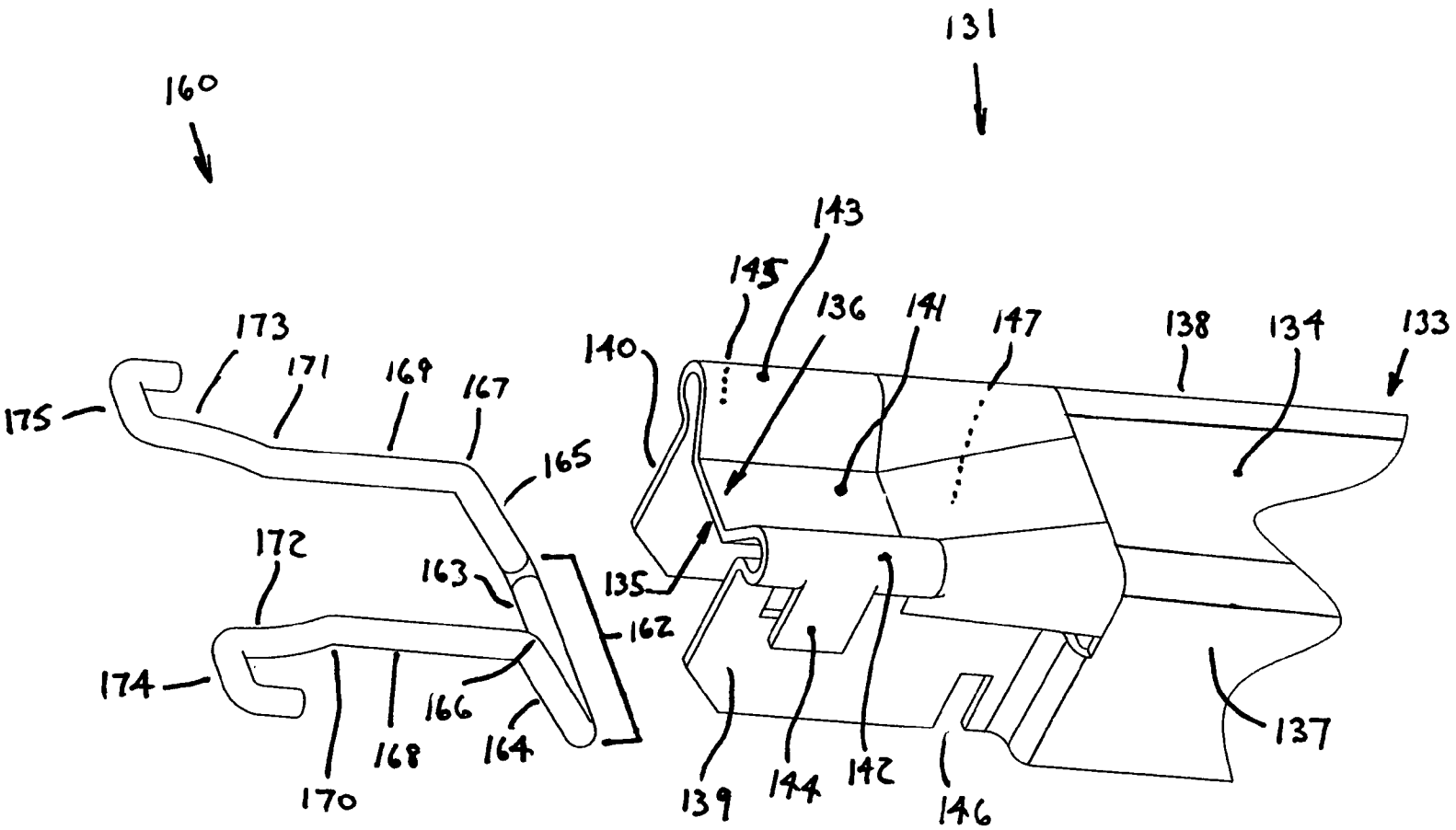
FIG. 7 is a perspective view of the Hook Means and the Lower end of the Housing, of the preferred embodiment.

The housing may have an Upper End 132, and a Lower End 133 (FIG. 1A). The U-shaped Housing 132 may have a base 134 that is generally flat with a top surface 135 and a bottom surface 136 and a pair of sidewalls—first sidewall 137 and second sidewall 138—extending from the top surface 135 (FIGS. 1A and 7). The sidewalls 137 and 138, are generally parallel to each other throughout the upper end 132 of housing 131, but angle and converge towards each other in the housing lower end 133. In both sidewall 137 and sidewall 138 there is preferably one or more orifices 148. These orifices in each sidewall may generally be in-line with each other, to be able to receive pins 15 and 16. The pins pass through one orifice of sidewall 139 and extends across the open area between each of the sidewalls to the orifice on the opposite sidewall 140. The pins 15 and 16 may have a head on one end to prevent the pin from passing through the orifice completely. The opposite end of the pin may be provided with a rivet type head to facilitate installation in U-shaped housing 131.

Figure 2:
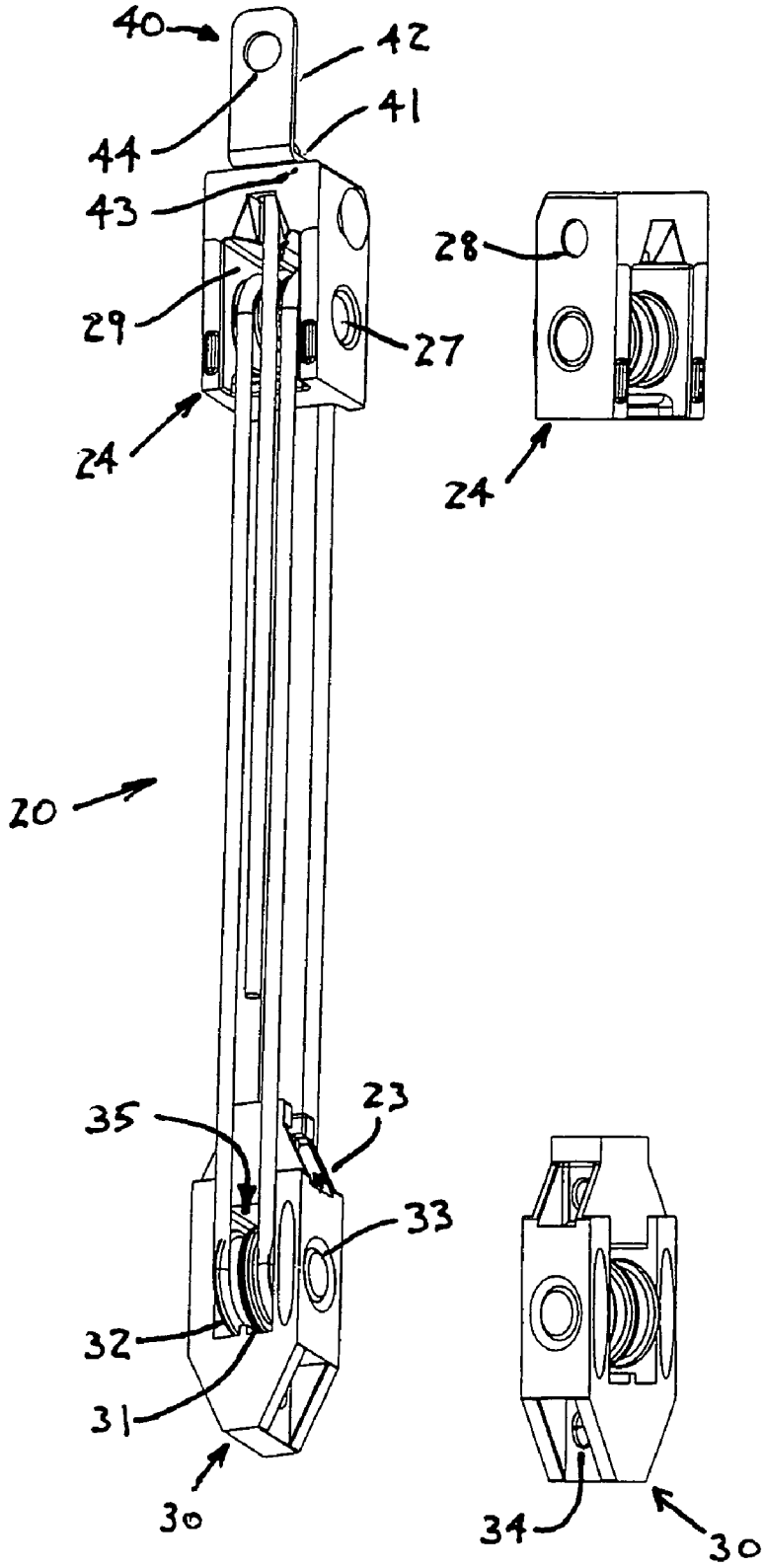
FIG. 2 is a front view and side view of the Block and Tackle arrangement.

Pin 15 may be utilized, as shown in FIG. 1, to mount the block and tackle pulley arrangement 20 in the housing 131. With the block and tackle pulley arrangement 20 set into the U-shaped housing 131, pin 15 may be inserted into the in-line orifices 148 of housing 131 to attach the rectangular frame 24 of block and tackle pulley arrangement 20 using orifice 28 of frame 24 to the housing 131. In the preferred embodiment, a helical member 50 with a plurality of turns 53 creates a spring having a first end 51 and a second end 52. The ends 51 and 52 may be configured many different ways, but preferably form an open hook. End 51 of helical member 50 may be hooked onto pin 16. Due to the location of pin 16 and the specific length of interconnection means 21 of the block and tackle pulley arrangement 20, a minimal force will need to be applied to end 52 of helical member 50 in order for it to reach and then hook through orifice 34 of diamond shaped frame 30 of the block and tackle pulley arrangement 20. This will pre-load the block and tackle pulley arrangement 20 so that mounting clip 20 is maintained flush to the top of rectangular frame 24. For a different window configuration, the length of interconnection means 21 may alternatively be increased so no preload is necessary, such that the mounting clip may hang from the end of frame 24 (FIG. 2). But, the length of interconnection means 21 is often set so a small pre-load maintains the mounting clip 20 flush with frame 24.

In the preferred embodiment, the lower end 133 of housing 131 (FIGS. 1 and 7), where the sidewalls 137 and 138 converge, may also have a step 139 in first sidewall 137, a step 140 in second sidewall 138, and a step 141 in base 134. The sidewall steps 139 and 140 may include, in a preferred embodiment, notches 146 and 147, respectively. The notches 146 and 147 may be V-shaped, U-shaped, octagonal-shaped, or some other appropriate shape, but in the preferred embodiment, notches 146 and 147 are rectangular. In the preferred embodiment, the converging sidewalls in lower end 133 of housing 131, as well as the sidewall step 138 and step 141 in base 134, enable formation of first curved wall 142, which is at the junction of sidewall step 139 and base step 141. Second curved wall 143 is likewise formed at the junction of sidewall step 140 and base step 141. The first and second curved walls 142 and 143, in a preferred embodiment, contain extensions 144 and 145, respectively.

In a preferred embodiment, Hook Means 160 may be comprised of a buckle portion 162, where the buckle portion is formed by the cross-arm 163, and first and second buckle arms, 164 and 165. The buckle arms 164 and 165 may each have corresponding bends 166 and 167, which lead to corresponding first and second buckle legs 166 and 167. The first and second buckle legs 166 and 167 may terminate in double bends 170 and 171, respectively, which connect to first offset leg 172 and second offset leg 173. At the end of offset legs 172 and 173 may be curved portions that make up the first end hook 174 and second end hook 175, of hook means 160.

Figure 9:
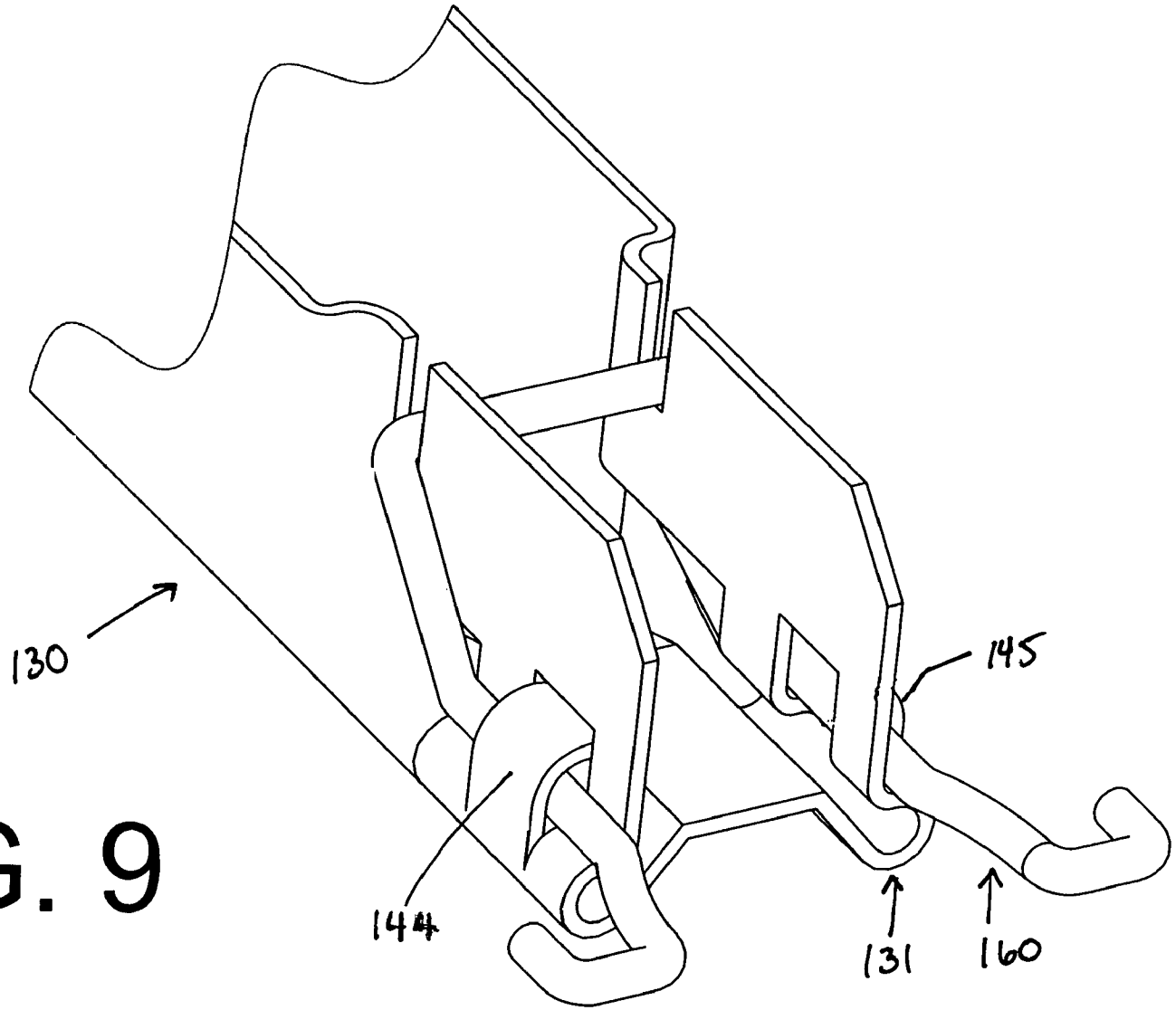
FIG. 9 is a perspective view showing the retaining tab of the U-shaped channel bent around the hook means, to permanently attach the hook to the channel, in the preferred embodiment.

In the preferred embodiment, hook means 160 may nest into the housing lower end 133 as seen in FIG. 8. The hook means 160 may nest by having the buckle cross-arm 163 of the hook means 160 fitting within notches 146 and 147 of housing 131, so that buckle arms 164 and 165 are outside of sidewall steps 139 and 140. Also, the hook means may be rotated, while buckle cross-arm 163 rests in notches 146 and 147, such that the buckle first leg 168 nests between sidewall step 139 and extension 144, and buckle second leg 169 nests between sidewall step 140 and extension 145. With the hook means 160 nested within lower end 133 of housing 131, the extensions 144 and 145 may be deformed, as seen in FIG. 9, to fix the hook means 160 to the housing.

Figure 10:
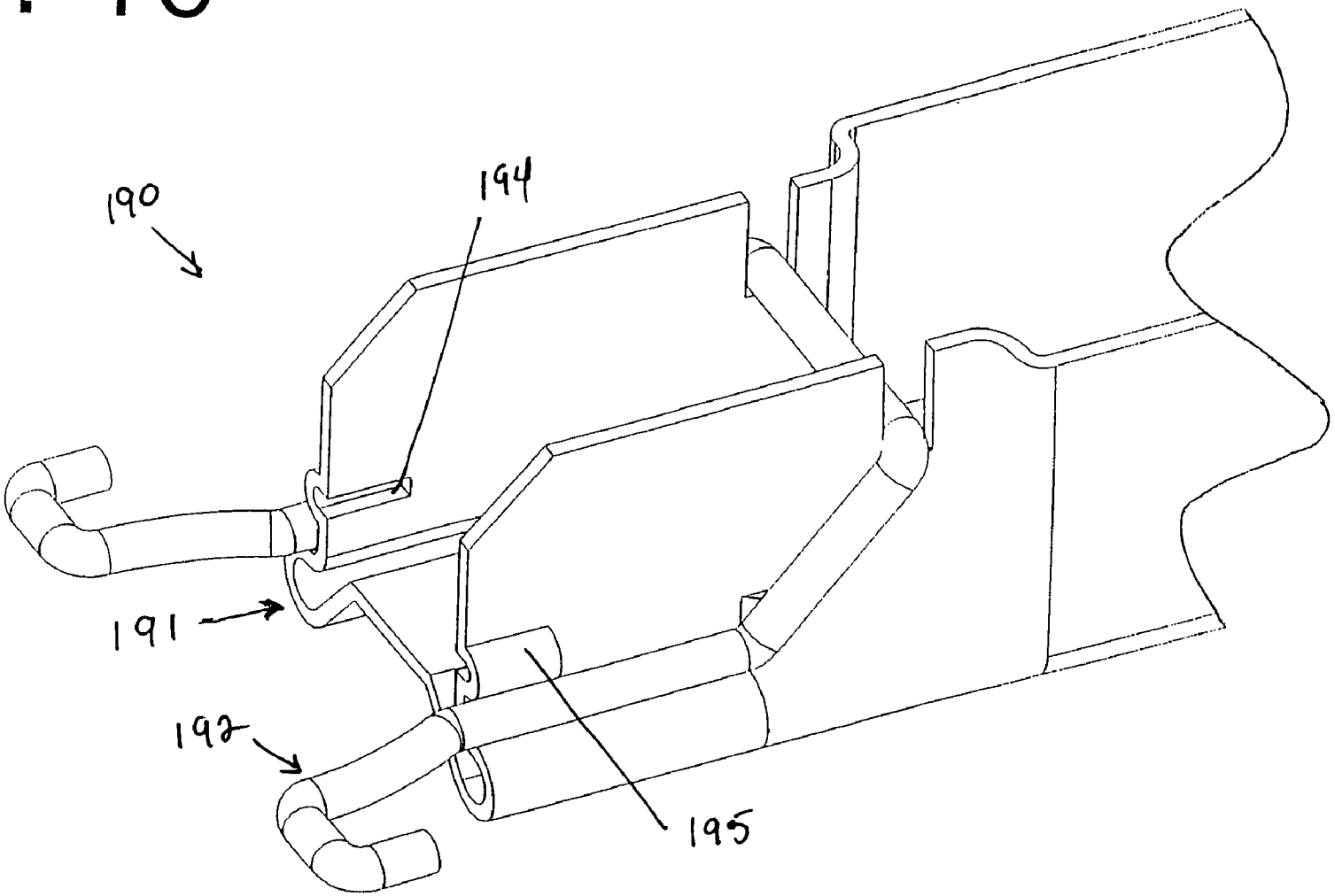
FIG. 10 is a first alternate embodiment of the hook means and housing.

There are many possible alternate embodiments for the hook means and corresponding attachment features of the housing. In a first alternate embodiment, Housing Assembly 190, shown in FIG. 10, may have hook means 192 that closely resembles hook means 160 of the preferred embodiment, but without double bends 170 and 171, and without offset legs 172 and 173. As with the preferred embodiment, a cross-arm of the hook means would nest within notches in the housing. However, the housing 191, instead of having extensions 144 and 145 to be deformed around the hook means 192, may have raised beaded portions 194 and 195. The beads 194 and 195 would wrap partially around the hook means 192, and provide a convenient point for application of a single weld to secure the hook means 192 to the housing 191.

Figure 11:
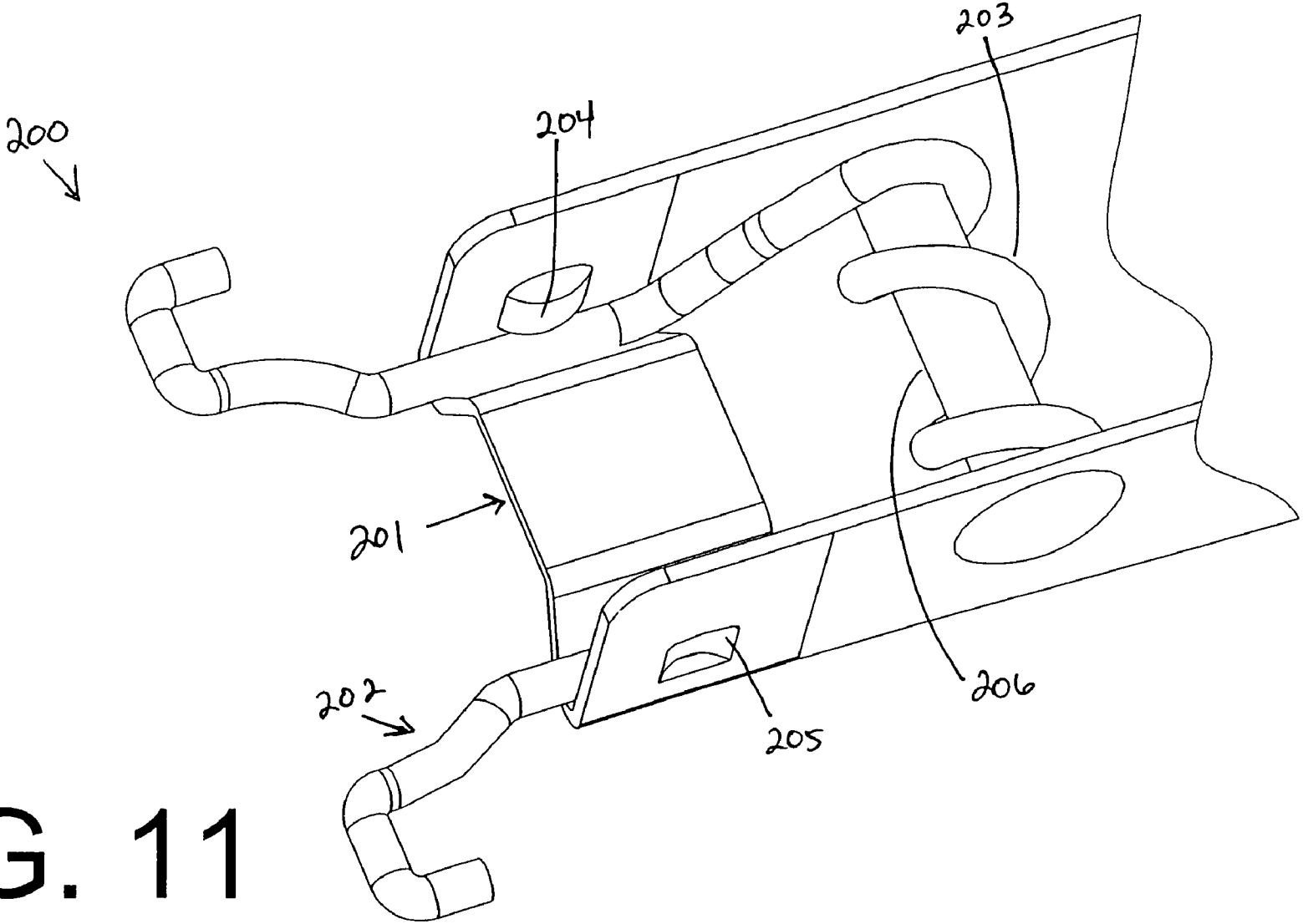
FIG. 11 is a second alternate embodiment of the hook means and housing.

In a second alternate embodiment, Housing Assembly 200, shown in FIG. 11, may have hook means 202 that closely resembles hook means 160 of the preferred embodiment, except that the buckle first leg 168 and buckle second leg 169 may be closer together so as to be trapped on the inside of the housing 201 side walls. A portion of the sidewalls of housing 201 are dimpled to create dimple 204 and 205 to fix part of the hook means to housing 201. The other end of the hook means, instead of having the straight cross-arm of the preferred embodiment, may have several helical turns 203, about pin 206, where pin 206 extends between the housing sidewalls.

Figure 12:
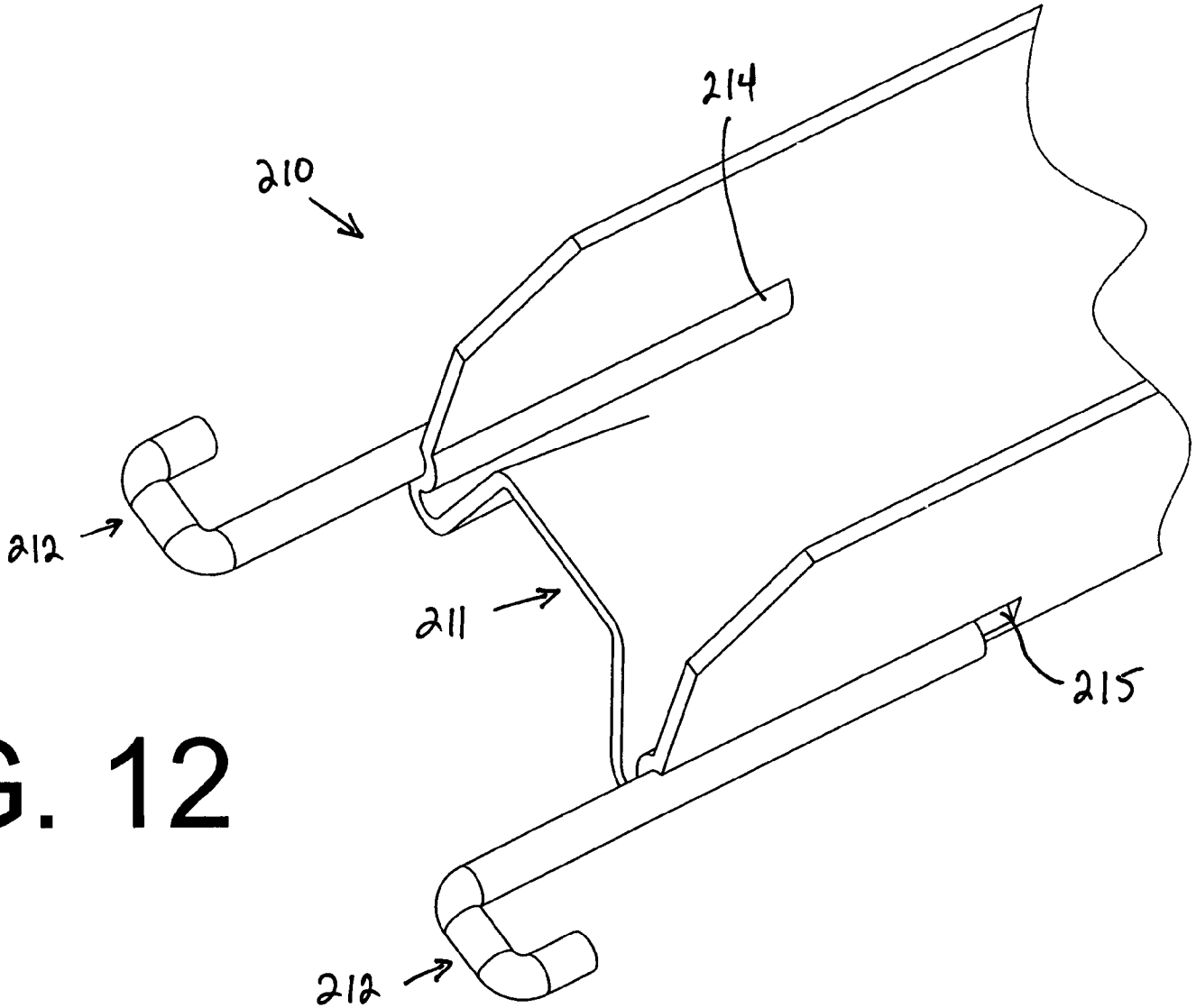
FIG. 12 is a third alternate embodiment of the hook means and housing.

In a third alternate embodiment, Housing Assembly 210, shown in FIG. 12, may have hook means 212 in the form of a simple J-hook shape. Two hooks 212 are set into recesses 214 and 215, which are created by deforming the outside of the sidewalls of the housing 211. Each of the hooks 212 may then be welded, in at least one location and preferably two or more locations, to permanently fix the hooks 212 to housing 211.

Figure 13:
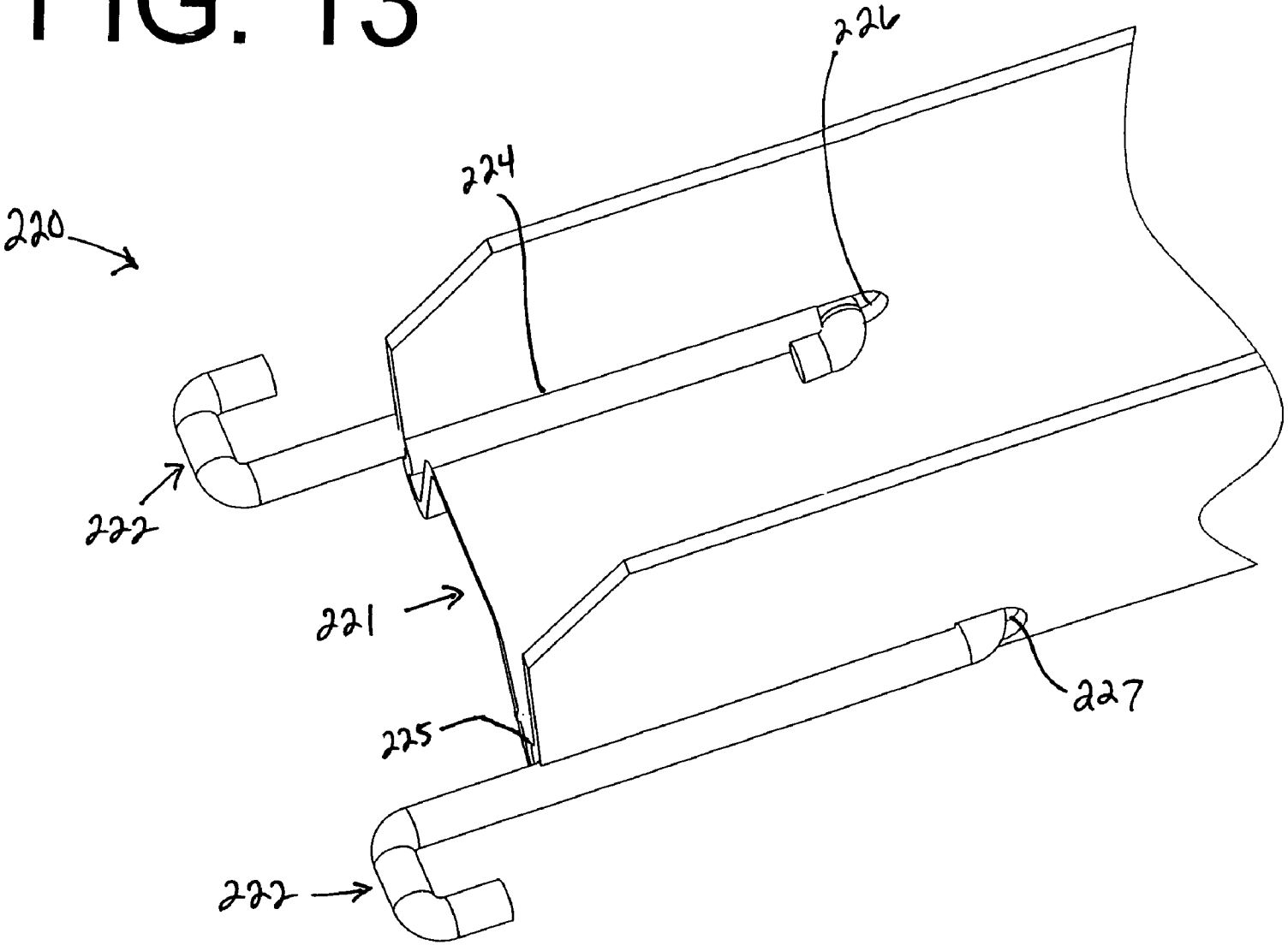
FIG. 13 is a fourth alternate embodiment of the hook means and housing.

In a fourth alternate embodiment, Housing Assembly 220, shown in FIG. 13, may have hook means 222 in the form of an S-shaped hook. The two S-shaped hooks 222 may be set into recesses 224 and 225 in housing 221, where the recesses may be created by deforming the outside of the sidewalls of the housing 221. The housing 221 additionally may have an elongated orifices, 226 and 227, in the sidewalls to accommodate insertion of one end of the S-shaped hook, which, along with the recesses, assists in fixing the S-shaped hooks 222 to the housing 221. Each of the hooks 222 may then be welded at a location to permanently fix them to housing 211.

Figure 3:
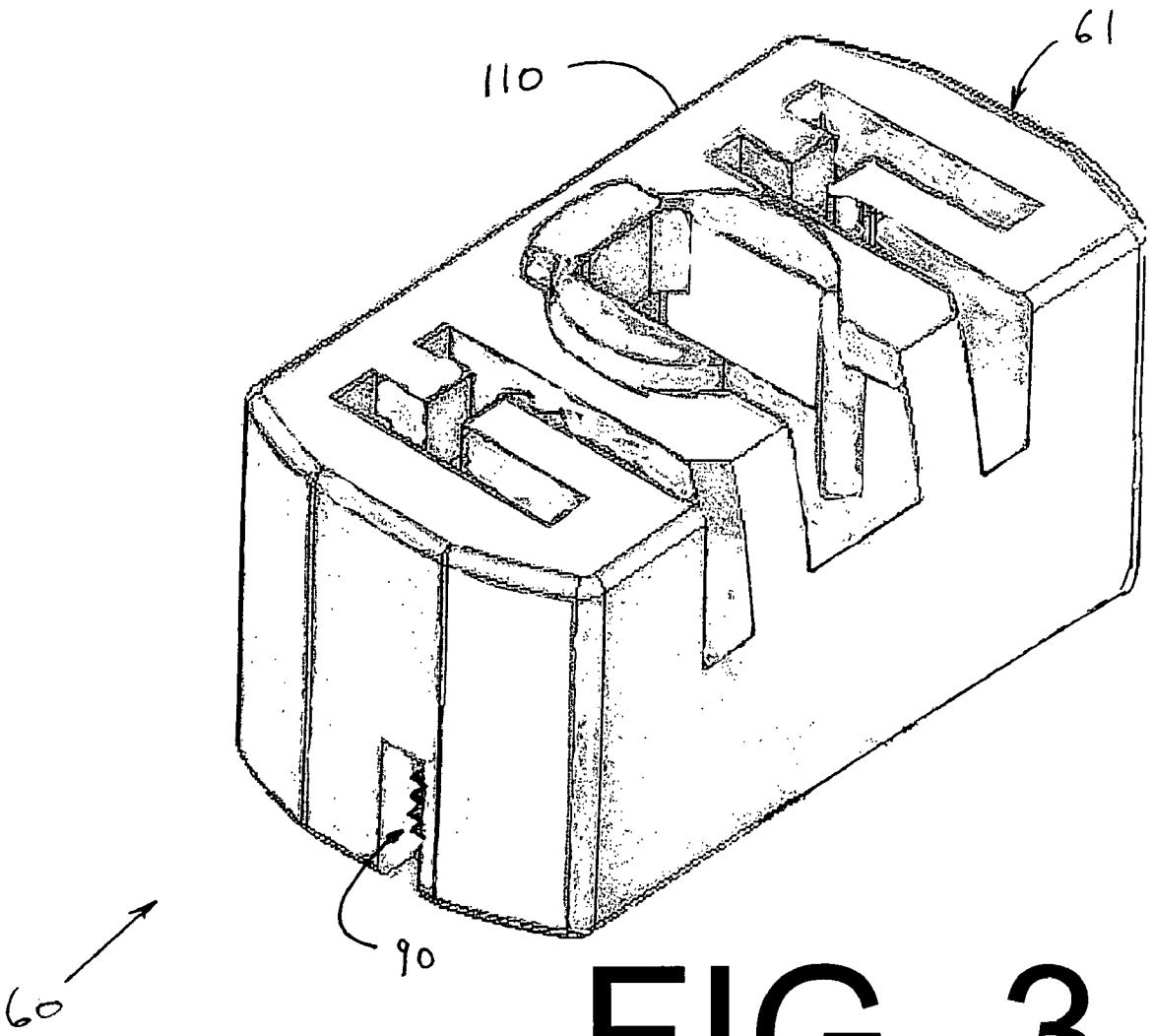
FIG. 3 is a perspective view of the top of the Shoe Assembly.

With the preferred embodiment, and similarly with any of the four alternate embodiments, the first and second end hooks 174 and 175 may be designed to provide for attachment and retention of the shoe assembly 60, which is shown in FIGS. 3 and 4. Shoe assembly 60 may, in a preferred embodiment, be comprised of shoe 61, leaf spring 90, and cam 110.

Shoe 61 may, of course, take many different geometric shapes, but is shown in a preferred embodiment (FIG. 5) as a rectangular block-shaped member having a generally flat top 62 and bottom 63, as well as a generally flat front 64 and back 65. First and second ends 66 and 67 may also be flat, but preferably have some curvature to assist in installing the Block and Tackle Balance Assembly with Rotatable Shoe 10 of this invention in a window frame 180.

An orifice 70 may be located in shoe 61, with the orifice being generally centered upon and extending up from the bottom 63 of the shoe. Orifice 70 preferably does not reach top 62, and orifice 68, being smaller than but in-line with orifice 70, may run from top 62 of shoe 61 into orifice 70, to create shoulder 80.

On top 62 of shoe 61 (FIG. 5), between orifice 68 and first shoe end 66, may be a set of openings, 71, 73, and 72. Openings 71, 72 and 73 may follow many different simple geometric forms, and could be also have a more complex shape including simple and complex curvature. However, in a preferred embodiment, openings 71, 72, and 73 are generally rectangular openings. Opening 73 in top 62 may generally be parallel to first shoe end 66, and may reach a depth approximately midway between top 62 and bottom 63. Opening 73 may, but does not reach front 64 or back 65 of shoe 61 in the preferred embodiment. Opening 71 may generally be parallel to and comparable to rectangular opening 73, except that opening 71 extends to front 64, and opening 71 may also interrupted by small protrusions that form detent 77 and detent 82 (see FIGS. 5 and 6). Opening 72, in the preferred embodiment, may be generally perpendicular to openings 71 and 73 and connects opening 71 with opening 73. Opening 72 may generally be rectangular, and may also narrow, or dog-leg, or have curvature, or even have protrusions forming a detent, any of which may occur near the midpoint between top 62 and bottom 63, to be capable of rotatably mounting the first and second end-hooks of hook means 160 (see FIG. 6).

Openings 74, 75, and 76 may be comparable to openings 71, 72, and 73, and in the preferred embodiment, are mirror image openings that are located on top 62, but on the opposite side of orifice 68. They may similarly include detents 78 and 83 in opening 74.

Shoe 61 may have one other opening, 69, which is on top 62 and may generally be parallel to openings 71, 73, 74, and 76. Opening 69 may be of any suitable shape including trapezoidal, but in the preferred embodiment it is roughly rectangular in shape. Opening 69 may connect orifices 68 and 70 with front 64, but opening 69, in the preferred embodiment, does not extend all the way to bottom 63, and instead stops approximately midway between top 62 and bottom 63.

Bottom 63 of shoe 61 may have two other features—opening 79 and orifice 81—to accommodate leaf spring 90, however, they are more aptly described in a later paragraph, following the description of the leaf spring 90.

Cam 110 may have a top 112 and a bottom 113, and may feature a cylindrical shape 111 that may begin at bottom 113, but generally stops short of top 112, in the preferred embodiment. A second cylindrical shape 114, having a diameter less than that of cylinder 111 but a common axis, may run from the top 112 to where cylinder 111 stops, forming shoulder 121. Cam 110 may have an opening 119 in portions of top 112, cylinder 114 and cylinder 111, but opening 119, in the preferred embodiment, does not penetrate both sides of cylinders 114 and 111 (see FIG. 5). Opening 119 may also be any suitable simple or complex geometric shape including trapezoidal, but in the preferred embodiment it is generally rectangular. Extending from a portion of cylinder 114 may be a flange or lip 115 that is generally located opposite opening 119. Lip 115 may run from top 112 but stops short of shoulder 121, in the preferred embodiment, such that the distance between lip 115 and shoulder 121 is approximately the same as the distance, on shoe 61, between top 62 and shoulder 80. This arrangement permits installation of cam 110 into shoe 61 by inserting top 112 of cam 110 into orifice 70 on bottom 63 of shoe 61, with the lip 115 of cam 110 oriented to be inline with opening 69 of shoe 61. Cam 110 may be inserted until shoulder 121 of the cam 110 reaches shoulder 80 of shoe 61, at which point cam 110 may be rotated within orifice 70 and orifice 68 of shoe 61. Cam 110 may have generally flat portions 117 and 118 on cylinder 111. Flat portions 117 and 118 may run from flange 116 on bottom 113 to approximately midway between top 112 and bottom 113. Flat portions 116 and 117 are designed to interact with leaf spring 90 as discussed in the following paragraph. Also, cam 110 may have a flange 116 on bottom 113 to assist in retaining leaf spring 90 within shoe 62. This cam configuration with flange 116 would necessitate installing the cam 110 into shoe 61 after installing the leaf spring 90, which is also described below.

Leaf spring 90 may take many different shape, but, in a preferred embodiment (FIG. 5), is Ω-shaped, having an outer surface 91, inner surface 92, a top 94, a bottom 93, a first end 95, and a second end 96. The ends 95 and 96 may have teeth 97. The leaf spring 90 may have a curved portion 98, which may connect, through bends 99 and 100, to first angled leg 101, and second angled leg 102, where angled leg 101 and curved portion 98 may be at an acute angle, and angled leg 102 and curved portion 98 may similarly form an acute angle. Bends 103 and 104 may connect angled legs 101 and 102 with angled base leg 105 and angled base leg 106, respectively. Angled leg 101 and base leg 105 may additionally form an acute angle. Also, angled leg 102 and base leg 106 may similarly form an acute angle. The lengths of the angled legs 101 and 102, and base legs 105 and 106, as well as the respective acute angles formed, in the preferred embodiment, may be arranged so as to create a distance between bends 103 and 104 that is slightly less than the distance between flat portions 117 and 118 on cam 110, providing for proper loading and interaction between leaf spring 90 and cam 110.

Figure 5:
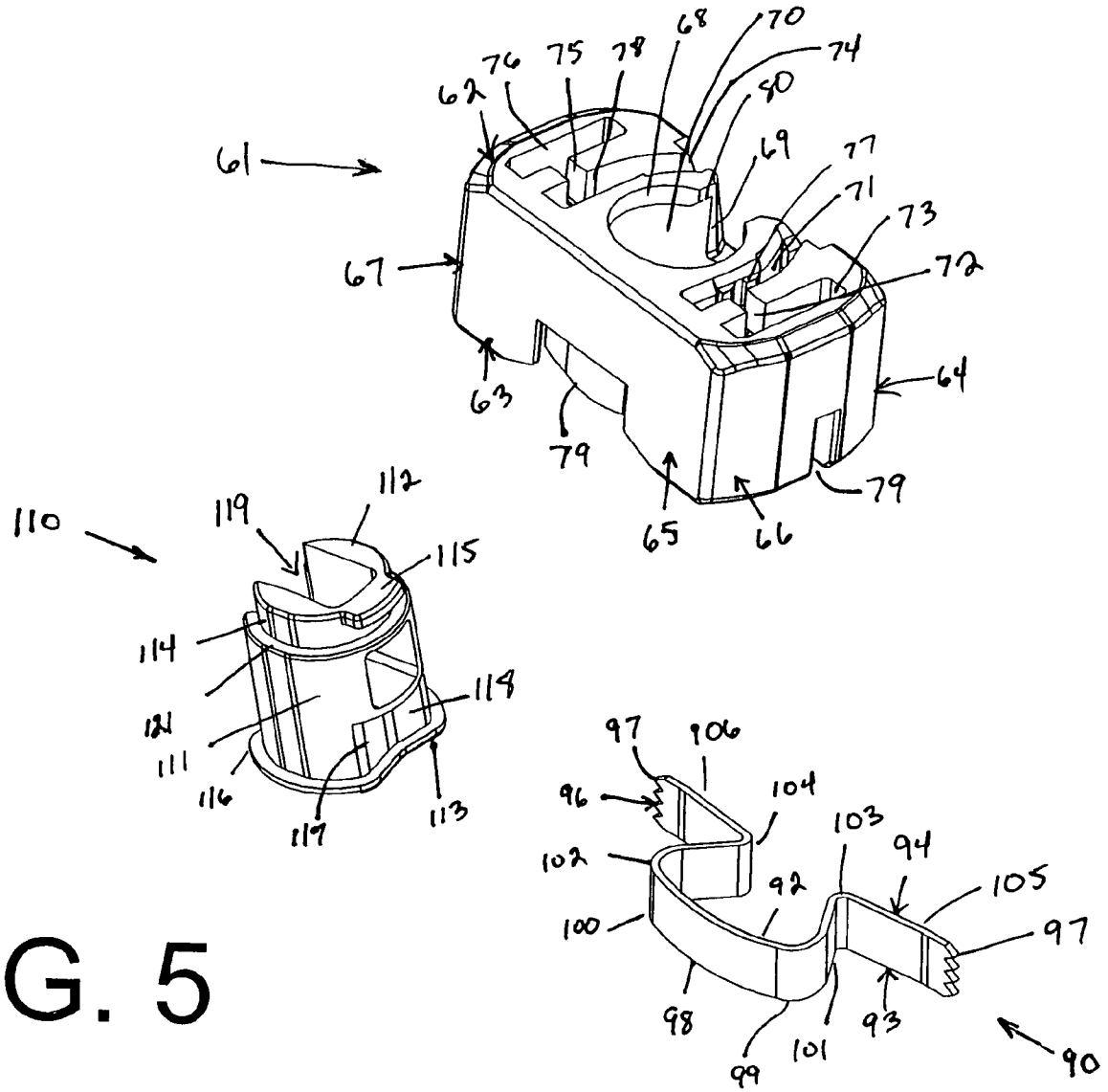
FIG. 5 is an exploded view of the components of the Shoe assembly, including the Shoe, Cam, and Leaf Spring.
Figure 6:
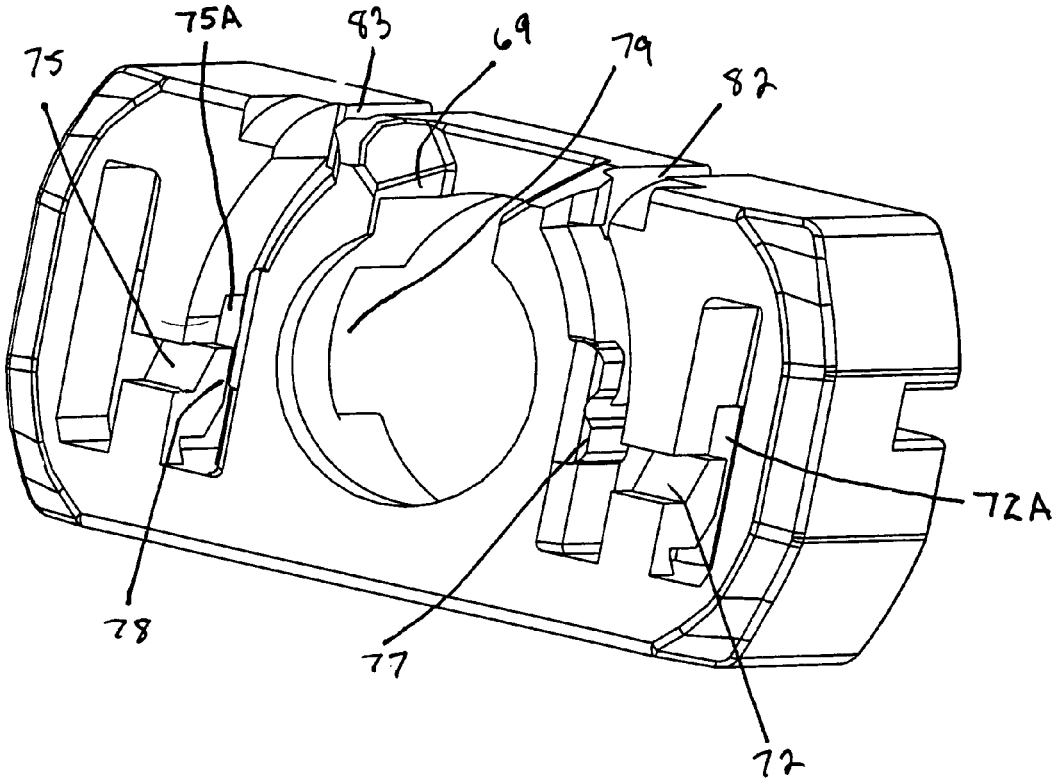
FIG. 6 is a perspective view of the openings in the Shoe.

As previously mentioned, bottom 63 of shoe 61 may have two other features to accommodate leaf spring 90—opening 79 and orifice 81—which are now appropriately described (see FIGS. 4 and 5). Orifice 81 may generally be provided in bottom 63 in approximately the same shape of flange 116 of cam 110. The depth of orifice 81 may be approximately equal to the thickness of flange 116 of cam 110.

The opening 79 on bottom 63 of shoe 61 may be irregularly shaped, however, in the preferred embodiment it generally follows the Ω-shape of leaf spring 90, and is to a depth approximately equivalent to the width of leaf spring 90, as shown by the distance between top 94 and bottom 93 of leaf spring 90. The opening 79 may extend to reach first and second ends 66 and 67 of shoe 61, as well as reaching back 65 of shoe 61 (FIG. 5). The opening 79 may also extend into orifice 70 of shoe 61 (see FIG. 6). With the leaf spring 90 inserted into opening 79 of shoe 61, the cam 110 may be installed into shoe 61. The insertion will, in the preferred embodiment, require elastically deforming angled legs 101 and 102 of leaf spring 90 so that the opening between bends 103 and 104 of leaf spring 90 is large enough to accommodate admitting cylinder 111 of cam 110. Installation will be complete when flange 116 of cam 110 is flush with bottom 63 of shoe 61.

The normal at-rest cam position, in the preferred embodiment, occurs when bends 103 and 104 of leaf spring 90 rest on flat portions 117 and 118 of cam 110. This at-rest position corresponds to the sliding sash window, which is capable of also pivoting open by using cam 110 to accomplish such pivoting, occupying the un-pivoted position.

This cam/spring arrangement of the preferred embodiment creates a preload between leaf spring 90 and cam 110 such that the leaf spring 90 behaves like a detent tending to initially inhibit rotation of the cam 110 within shoe 61, while the leaf spring bends 103 and 104 are positioned on flat portions 117 and 118, which is while the window is in the un-pivoted position. Once a sufficiently high force—a person seeking to pivot the window open—causes rotation of the cam 110 to widen the distance between bends 103 and 104 of leaf spring 90, and the bends 103 and 104 contact cylinder 111 of cam 110, cam (and window) rotation continues with application of a minimal force. This widening of the distance between bends 103 and 104 of leaf spring 90 may correspondingly cause the toothed ends 95 and 96 of leaf spring 90 to protrude beyond ends 66 and 67 of shoe 61. The toothed ends 95 and 96, when so protruding after the balance assembly has been installed in a window, may be used to prevent movement of the balance assembly relative to the window frame.

Figure 14:
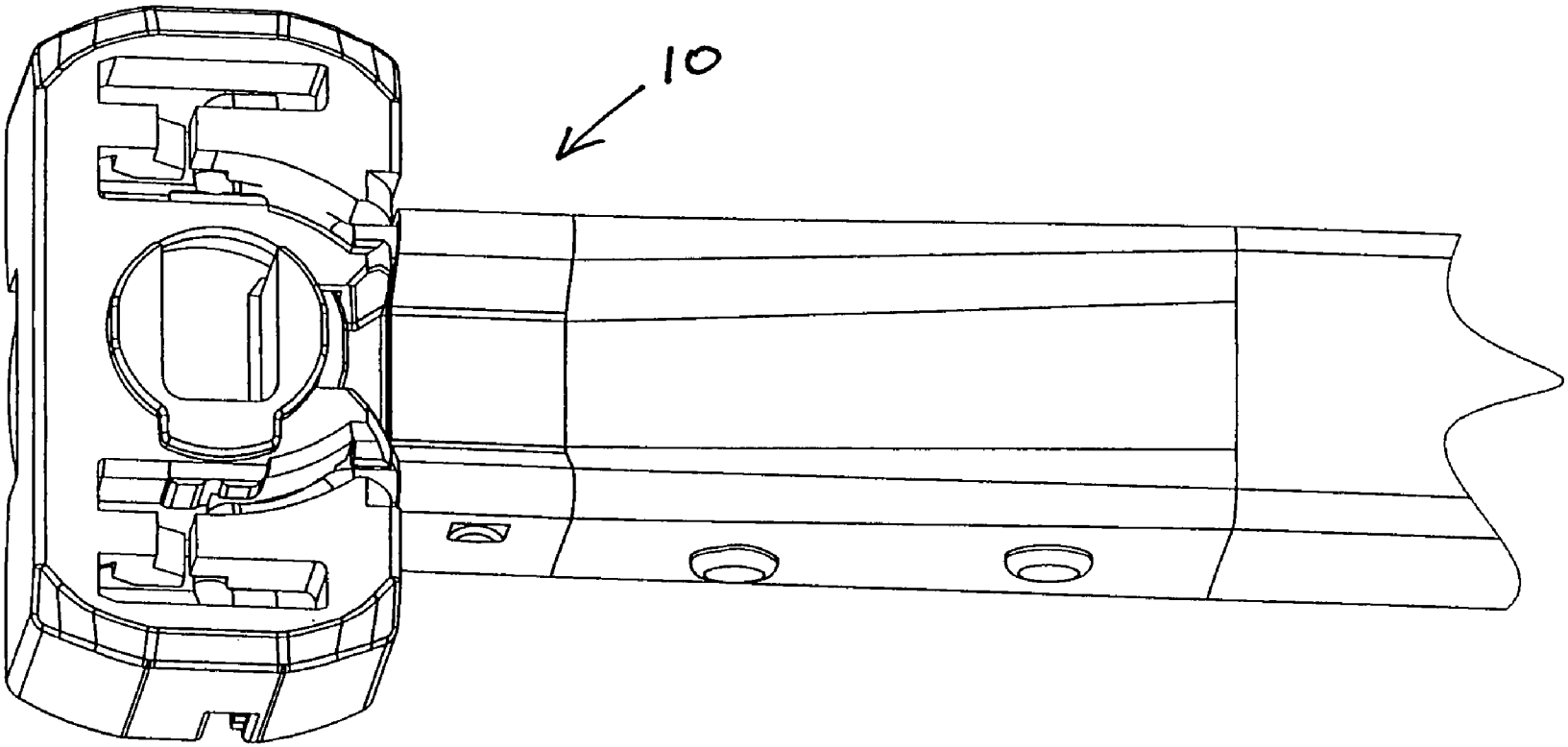
FIG. 14 is a perspective view of the Housing Assembly attached to the Shoe Assembly.
Figure 15:
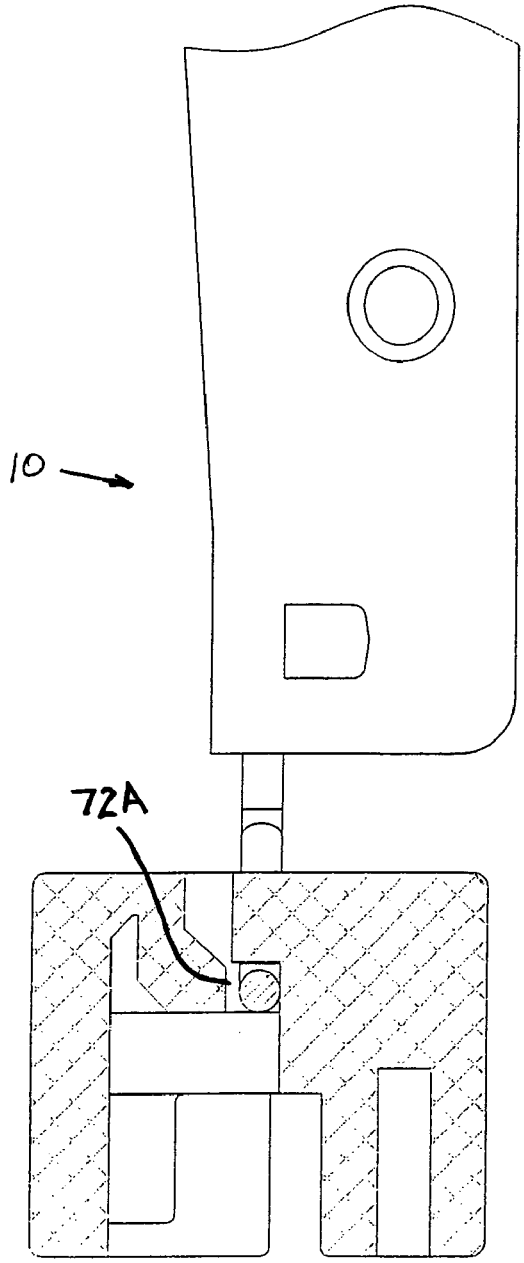
FIG. 15 is a side view of the Block and Tackle Balance Assembly with Rotatable Shoe, shown in the 90 degree rotated position, ready for installation in a window frame.
Figure 16:
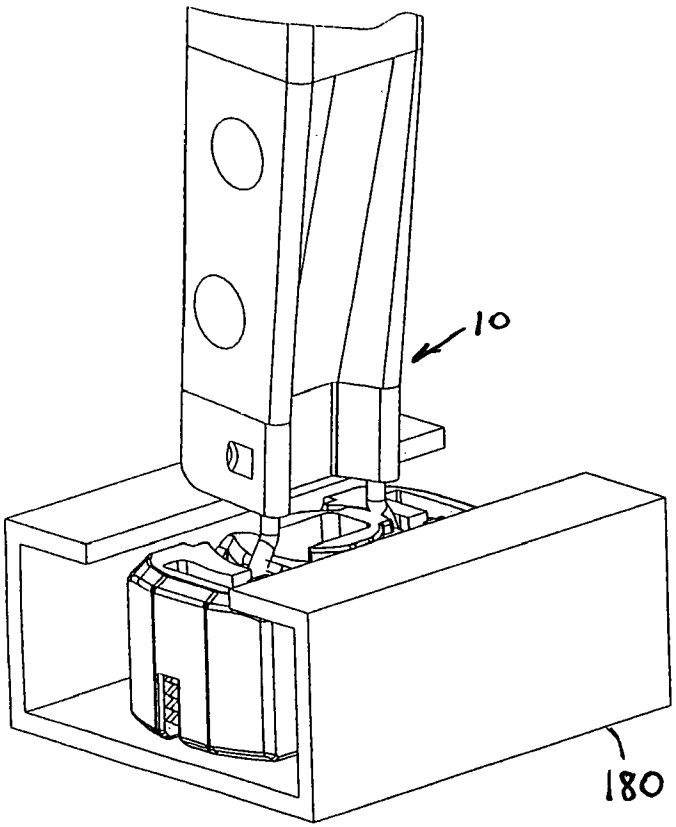
FIG. 16 is a perspective view of the Block and Tackle Balance Assembly with Rotatable Shoe shown in a 90 degree rotated position, after being set into a window frame.

Assembling the Block and Tackle Balance Assembly with Rotatable Shoe 10 will be completed, in the preferred embodiment, once the shoe assembly 60 (FIG. 3) is attached to housing assembly 130 (FIG. 9). Attachment of housing assembly 130 to shoe assembly 60 may be accomplished by inserting the first and second hook ends 174 and 175 of hook means 160 (FIG. 7) into openings 72 and 75 (FIG. 5) until passing the angled surfaces to be urged, through a narrow area, into the rectangular openings 72A and 75A (FIG. 6, FIG. 14, and FIG. 15), which then pivotally retrain the hook means. The housing assembly 130 may be retained, by detents 77 and 78 of shoe 61, in the 90 degree rotated position, as shown in FIG. 15, which facilitates installation into the C-shaped window frame 190, as shown in FIGS. 16 and 17.

This rotation ability of the shoe permits installation, of the Block and Tackle Balance Assembly with Rotatable Shoe 10, into a window frame at any stage of the window assembly sequence. The balance assembly thus may be installed at a more advantageous time in the assembly sequence.

Figure 17:
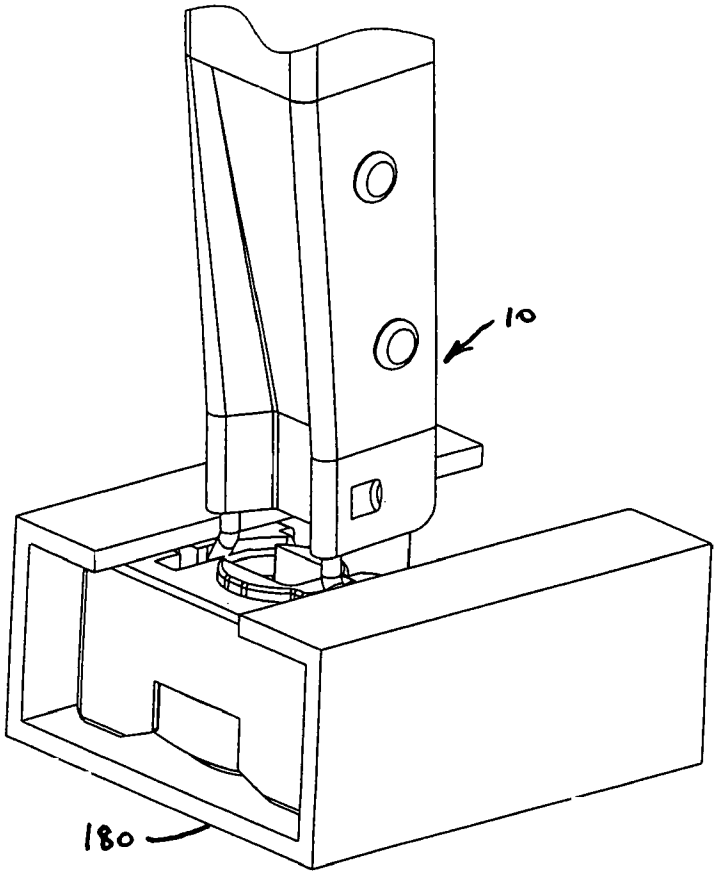
FIG. 17 is a perspective view of the assembly shown in the 90 degree rotated position after installation in a window frame, and with the assembly twisted 90 degrees for final shoe orientation relative to the window frame.
Figure 18:
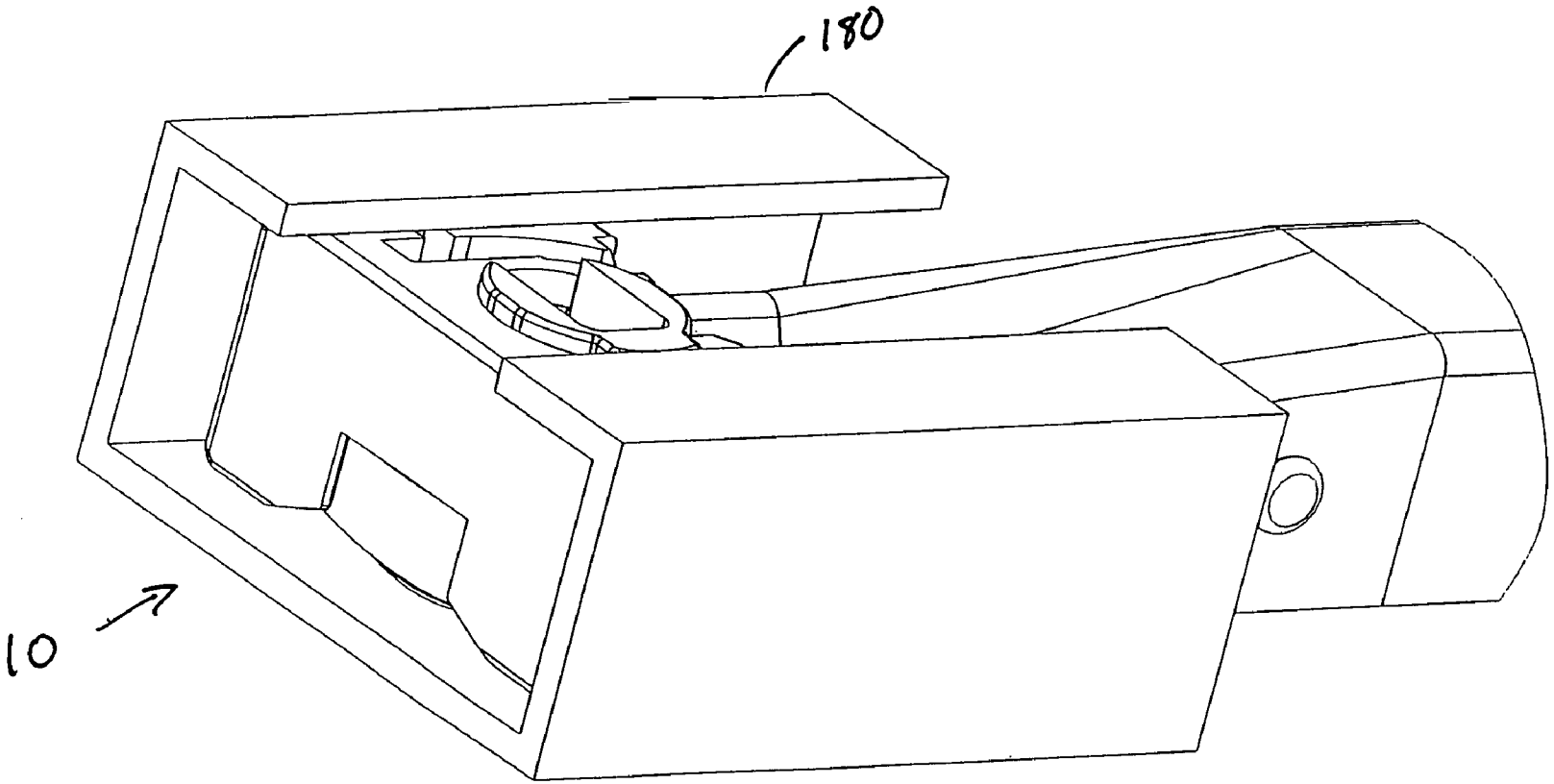
FIG. 18 is a perspective view of the assembly shown in the zero degree position after installation in a window frame, with part of the frame cut away to permit viewing the assembly.
Figure 19:
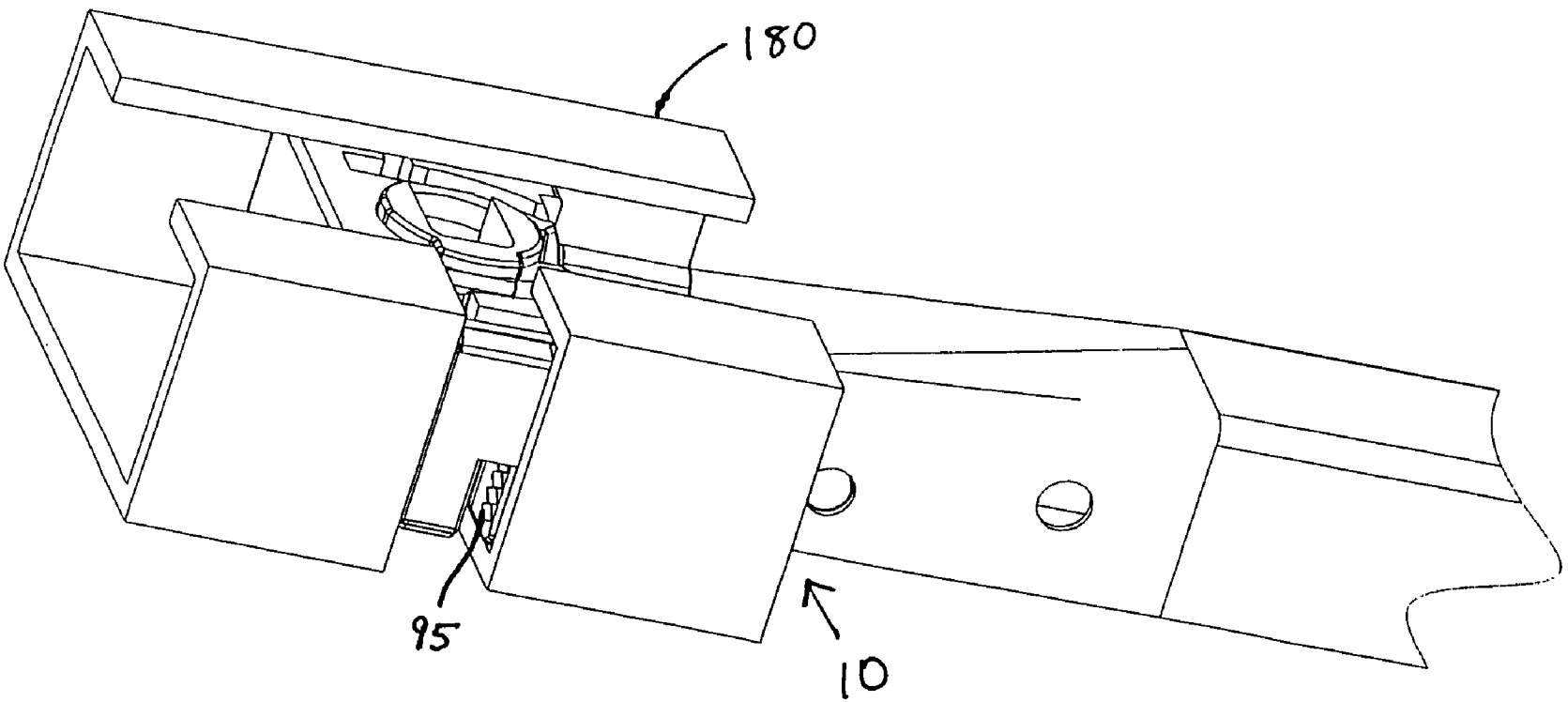
FIG. 19 is a perspective view of the assembly shown in the zero degree position after installation in a window frame, with part of the frame cut away to permit viewing the assembly, which has the toothed leaf spring exposed, which may contact the window frame.

Once inserted into the window frame 190 (FIG. 16), the Block and Tackle Balance Assembly with Rotatable Shoe 10 may be twisted 90 degrees (FIG. 17). A force can then be applied to the housing assembly 130 to overcome the detents 77 and 78 in shoe 61, and the housing assembly 130 can be rotated to the zero degree position for final installation into the window frame, as shown in FIG. 18. Detents 82 and 83 (FIG. 6) provide a positive tactile signal for when the assembly has reached the zero degree position, as well as provide a means for retaining the housing and shoe at the zero-degree position. It should be noted that throughout the installation of the Block and Tackle Balance Assembly with Rotatable Shoe 10, bottom 63 of shoe 61 always maintains contact with the window frame.

Other modifications, substitutions, omissions and changes may be made in the design, size, materials used or proportions, operating conditions, assembly sequence, or arrangement or positioning of elements and members of the preferred embodiment without departing from the spirit of this invention as described in the following claims.

We claim:

1. A balance assembly for use in a sliding sash window, said balance assembly comprising:

(a) a housing having an upper end and a lower end;

(b) a pulley arrangement where at least a portion of said pulley arrangement is located within said housing; said pulley arrangement comprising one or more pulleys and an interconnection means that interacts with said one or more pulleys; said interconnection means having a first end and a second end, said first end being fixed to a portion of said pulley arrangement;

(c) a spring means with a first end and a second end, wherein said first end of said spring means biases at least a portion of said pulley arrangement relative to said housing;

(d) a shoe member, wherein said shoe member has an orifice and one or more openings, said shoe being attached to said housing such that said shoe is capable of rotating, relative to said housing, from a first position to a second position;

(e) a hook means, said hook means comprising a first end hook and a second end hook, said first and second end hooks being rotatably connected to said shoe, said hook means further comprising a cross arm, said first and second hook ends being connected by said cross arm, at least a portion of said cross arm comprising one or more helical turns, said hook means providing said attachment of said shoe to said housing, and (f) a cylindrically shaped cam having a top end and a bottom end, and an opening in at least a portion of said cam; said cam being installed in said orifice of said shoe such that said cam is capable of pivoting within said shoe.

2. The balance assembly of claim 1 wherein said shoe of said balance assembly is capable of being fitted into a window frame from the side of the window frame, when said shoe is rotated into said first position.

3. The balance assembly of claim 2 wherein said balance assembly installation into the window frame is completed by twisting said balance assembly, and by rotating said housing relative to said shoe such that said shoe occupies said second position.

4. The balance assembly of claim 1 wherein said shoe rotation relative to said housing is about an axis that is perpendicular to an axis formed by the length of said housing and perpendicular to an axis formed by the height of said housing.

5. The balance assembly of claim 4, wherein said shoe rotation between said first and second positions comprises rotation of approximately 90 degrees.

6. The balance assembly of claim 1 wherein said first end hook and said second end hook are fixed to said housing by deforming at least a portion of said housing around a portion of said hook ends.

7. The balance assembly of claim 6 wherein a cross-arm, which connects said end hooks, is fixed to said housing by nesting within at least one notch in said housing.

8. The balance assembly of claim 6 wherein a portion of said hook means is located on an inside surface of said housing.

9. The balance assembly of claim 8 wherein said deformities are dimples in said housing.

10. The balance assembly of claim 9 wherein at least one portion of said hook ends contacts said dimples to fix said hook ends to a portion of said inside surface of said housing.

11. The balance assembly of claim 10 wherein said cross-arm of said hook means is fixed to said housing by a pin in said housing that passes through said one or more helical turns in said cross arm.

12. The balance assembly of claim 1 wherein said first end hook and said second end hook are fixed to said housing by welding at least a portion of said housing to at least a portion of said end hooks.

13. The balance assembly of claim 12 wherein said first end hook and said second end hook each have a second hook to form S-shaped hooks.

14. The balance assembly of claim 13 wherein said second hook of said first and second end hooks each are attached to said housing through an orifice in said housing.

15. The balance assembly of claim 12 wherein said first end hook and said second end hooks each have a second weld between at least a portion of said housing to at least a portion of said end hooks.

16. The balance assembly of claim 12 wherein a cross-arm, which connects said end hooks, is fixed to said housing by nesting within at least one notch in said housing.

17. The balance assembly of claim 1, wherein said openings of said shoe comprise one or more detents that inhibit motion of said shoe relative to said hook means when said shoe is in said first shoe position.

18. The balance assembly of claim 17, wherein said openings of said shoe comprise one or more detents that inhibit motion of said shoe relative to said hook means when said shoe is in said second shoe position.

19. The balance assembly of claim 1 wherein said housing has an elongated base with a top surface and a bottom surface and a pair of sidewalls extending from said top surface to form a U-shaped channel.

20. The balance assembly of claim 1 wherein said cylindrically-shaped cam has at least one generally flattened portion on said cylindrical shape.

21. The balance assembly of claim 1 wherein a leaf spring is nested within said shoe and contacts said flat portion on said cam during sliding of said window, and co-act with said cylindrical shape of said cam to inhibit sliding motion of said window during pivoting of said cam and window; and wherein said sliding motion being inhibited is by said co-action between said leaf spring and said cylindrical portion of said cam causing teeth on one or more ends of said leaf spring to extend outward from said shoe and engage a portion of said c-shaped window frame.

22. The balance assembly of claim 21 wherein said leaf spring is Ω-shaped, having a curved portion, and at least two base legs.

23. The balance assembly of claim 1 wherein said spring means comprises a helical tension spring.

24. The balance assembly of claim 1 wherein said pulley arrangement comprises two pulleys in an upper portion and two pulleys in a lower portion.

25. The balance assembly of claim 24 wherein said pulley blocks comprising said upper portion are rotatably attached to said upper end of said housing.

26. The balance assembly of claim 25 wherein said pulley blocks comprising said lower portion are rotatably mounted in a pulley frame; and wherein said first end of said spring means is attached to said pulley frame to bias said pulley frame relative to said housing, said second end of said spring means being attached to a pin in said housing.

27. The balance assembly of claim 26 wherein said interconnection means winds about said pulleys of said upper and lower portions, with said second end of said interconnection means attaching to a mounting clip.

28. The balance assembly of claim 27 wherein said interconnection means comprises a flexible member from the group of flexible members consisting of: a cord, a cable, or a chain.

29. The balance assembly of claim 28 wherein said mounting clip comprises a first flange and a second flange, said second flange being oriented at roughly a 90 degree angle to said first flange; and wherein an orifice is located in said first flange of said mounting clip for attachment of said interconnection means, and a second orifice is located in said second flange for attachment of said mounting bracket.

30. The balance assembly of claim 18, wherein said shoe member comprises a generally block-shaped member having a top, a bottom, a front, a back, a first end, and a second end; and wherein said openings are in a portion of said top and a portion of said front of said shoe member to permit movement of said first and second hook members relative to said shoe during said rotation of said shoe.

31. The balance assembly of claim 30, wherein when said shoe member is in said first position, said shoe member of said balance assembly is installable width-wise through an opening in a c-shaped window frame, with said bottom of said shoe member contacting a side of said c-shape opposite to said window frame opening, said width being defined by a distance between said front and said back of said shoe.

32. The balance assembly of claim 31, wherein when said shoe member is in said first position and said bottom of said shoe member contacts a side of said c-shaped frame opposite to said frame opening, said housing of said balance assembly is installable into said frame by twisting said balance assembly 90 degrees, and by rotating said housing relative to said shoe until said shoe occupies said second position.

33. The balance assembly of claim 32 wherein said housing comprises an elongated base with a top surface and a bottom surface and a pair of sidewalls extending away from said top surface to have a U-shaped cross-section.

34. The balance assembly of claim 33, wherein said shoe rotation relative to said housing is about an axis perpendicular to an axis represented by a length of said elongated base, and perpendicular to an axis represented by a height of said sidewalls.

35. The balance assembly of claim 34, wherein said shoe rotation between said first and second positions comprises rotation of approximately 90 degrees.

36. The balance assembly of claim 35, wherein said pulley arrangement is comprised of at least one pulley being rotatably mounted proximate to said housing upper end, and at least one pulley rotatably mounted in a pulley frame, said pulley frame being disposed between said housing upper end and lower end, and said second end of said spring attaching to said pulley frame to bias said pulley frame relative to said housing.

37. The balance assembly of claim 36, wherein said interconnection means is threaded through said at least one pulley in said housing upper end and said at least one pulley mounted in said pulley frame, with said first end of said interconnection means being fixed to said pulley frame, and said second end of said interconnection means being attached to a mounting clip.

38. The balance assembly of claim 37, wherein said mounting clip comprises a first flange and a second flange, said first flange being usable for attaching said mounting clip to said c-shaped window frame, and said second flange being usable for attachment of said interconnection means thereto.

39. The balance assembly of claim 38, wherein when said mounting clip is attached to said c-shaped window frame and said shoe of said balance assembly is attached to a sliding window through said shoe orifice, said pulley arrangement causes said interconnection means to bias said housing upper end toward said mounting clip and thereby bias said window to counter the weight of said window.

40. The balance assembly of claim 39, wherein said interconnection means is a flexible member from the group of flexible members consisting of: a cord, a cable, or a chain.

41. The balance assembly of claim 40 further comprising a cylindrically-shaped cam member being pivotally disposed within said orifice in said shoe, said cam member having an opening in at least a portion of said cam for receiving said window attachment, said cam providing for pivotal movement of said window.

42. The balance assembly of claim 41 further comprising a leaf spring being nested within said shoe to co-act with a flat portion on said cylindrically-shaped cam during sliding of said window, and to co-act with said cylindrical shape of said cam to inhibit sliding motion of said window during said pivoting of said cam and window; and wherein said sliding motion being inhibited is by said co-action between said leaf spring and said cylindrical portion of said cam causing teeth on one or more ends of said leaf spring to extend outward from said shoe and engage a portion of said c-shaped window frame.

43. The balance assembly of claim 42, wherein said leaf spring is Ω-shaped, and said spring comprises is a helical tension spring.

44. A balance assembly for use in a sliding sash window, said balance assembly comprising:

a housing, said housing having an upper end and a lower end;

a pulley arrangement, at least a portion of said pulley arrangement being located within said upper end of said housing; said pulley arrangement comprising one or more pulleys and an interconnection means that interacts with said one or more pulleys; said interconnection means having a first end and a second end; said first end being fixed to a portion of said pulley arrangement;

a spring means, said spring means having a first end and a second end, said first end of said spring means being attached to said pulley arrangement to thereby bias at least a portion of said pulley arrangement relative to said housing;

a hook means, a portion of said hook means being fixed to said housing lower end, and a portion protruding therefrom; said hook means comprising a first end hook and a second end hook, said first and second end hooks being rotatably connected to said shoe;

a shoe, said shoe comprising an orifice and one or more openings, said shoe being rotatably attached to said protruding portion of said hook means, said shoe being thereby capable of rotating, relative to said housing, from a first position to a second position; and a cylindrically-shaped cam, said cam having a top end and a bottom end, and an opening in at least a portion of said cam; said cylindrically-shaped cam being pivotally installed in said orifice of said shoe a mounting clip, said mounting clip being generally disposed outside of said housing upper end, said second end of said connection means being secured to said mounting clip; and wherein said spring biasing said pulley arrangement causes said connection means to bias said mounting clip toward said housing upper end.

45. The balance assembly of claim 44, wherein said hook means further comprising a cross arm, said first and second hook ends being connected by said cross arm, and at least a portion of said cross-arm comprising one or more helical turns.

46. The balance assembly of claim 45, wherein a portion of said first end hook and a portion of said second end hook are each fixed to an inside surface of said housing by deforming at least a portion of said housing around a portion of said hook ends; and wherein said cross-arm is fixed to said housing by a pin in said housing that passes through said one or more helical turns of said cross arm.

47. The balance assembly of claim 44 wherein said openings in said shoe comprise two or more detents, at least one of said two or more detents inhibiting motion of said shoe relative to said hook means when said shoe is in said first shoe position.

48. A balance assembly comprising:

a housing; said housing having an upper end and a lower end;

a pulley arrangement; said pulley arrangement comprising: one or more pulleys, and an interconnection means that interacts with said one or more pulleys; said interconnection means having a first end and a second end; at least a portion of said pulley arrangement being located within a portion of said housing;

a spring; said spring having a first end and a second end, said first end of said spring connecting to said housing and said second end connecting to a portion of said pulley arrangement to bias said portion of said pulley arrangement relative to said housing;

a hook means, said hook means being secured to said lower end of said housing; and wherein said hook means comprises a first hook member and a second hook member, said first hook and second hook members being rotatably connected to said shoe; and wherein a portion of each of said first and second hook members are secured to said housing by deforming at least a portion of said housing around a portion of each of said first and second hook members and wherein said first and second hook members of said hook means are connected by a cross arm, at least a portion of said cross arm comprising one or more helical turns; and wherein said cross arm of said hook means is secured to said housing by a pin in said housing that passes through one or more helical turns; and a shoe member; said shoe member having an orifice, and having one or more openings for receiving said hook means; said shoe member being rotatably attached to said hook means to thereby be capable of rotating, relative to said housing, from a first position to a second position.

49. The balance assembly of claim 48, wherein said shoe comprises one or more detents that inhibit motion of said shoe relative to said hook means when said shoe is in said first shoe position; and wherein said shoe comprises one or more detents that inhibit motion of said shoe relative to said hook means when said shoe is in said second shoe position.

* * * * *